US007445407B2

(12) United States Patent
Rainey

(10) Patent No.: US 7,445,407 B2
(45) Date of Patent: Nov. 4, 2008

(54) MODULAR BLOCK CONNECTING TECHNIQUES

(75) Inventor: Thomas L. Rainey, Marietta, GA (US)

(73) Assignee: Earth Reinforcement Technologies, LLC, Woodstock, GA (US)

( * ) Notice: Subject to any disclaimer, the term of this patent is extended or adjusted under 35 U.S.C. 154(b) by 173 days.

(21) Appl. No.: 11/272,652

(22) Filed: Nov. 14, 2005

(65) Prior Publication Data

US 2007/0110523 A1 May 17, 2007

(51) Int. Cl.
*E02D 29/02* (2006.01)

(52) U.S. Cl. ..... 405/262; 405/284; 405/286; 52/600; 52/604

(58) Field of Classification Search ..... 405/262, 405/284, 286
See application file for complete search history.

(56) References Cited

U.S. PATENT DOCUMENTS

| | | | | |
|---|---|---|---|---|
| 4,824,293 | A * | 4/1989 | Brown et al. | 405/284 |
| 5,419,092 | A * | 5/1995 | Jaecklin | 52/562 |
| 5,921,715 | A | 7/1999 | Rainey | 405/262 |
| 6,019,550 | A * | 2/2000 | Wrigley et al. | 405/262 |
| 6,224,295 | B1 * | 5/2001 | Price et al. | 405/262 |
| 6,322,291 | B1 | 11/2001 | Rainey | 405/262 |
| 6,338,597 | B1 | 1/2002 | Rainey | 405/262 |
| 6,416,257 | B1 | 7/2002 | Rainey | 405/262 |
| 6,443,662 | B1 * | 9/2002 | Scales et al. | 405/262 |
| 6,536,994 | B2 | 3/2003 | Race | 405/262 |
| 6,612,784 | B2 | 9/2003 | Rainey et al. | 405/284 |
| 6,652,196 | B1 | 11/2003 | Rainey | 405/262 |
| 6,679,656 | B1 * | 1/2004 | Manthei | 405/284 |
| 6,709,201 | B2 | 3/2004 | Race | 405/262 |
| 6,758,636 | B2 | 7/2004 | Rainey et al. | 405/262 |
| 7,114,887 | B1 * | 10/2006 | Rainey | 405/262 |
| 2003/0009970 | A1 | 1/2003 | MacDonald et al. | |
| 2004/0134154 | A1 | 7/2004 | Bott | |

OTHER PUBLICATIONS

International Search Report and Written Opinion.

* cited by examiner

*Primary Examiner*—Tara L. Mayo
(74) *Attorney, Agent, or Firm*—Thomas, Kayden, Horstemeyer & Risley, LLP

(57) ABSTRACT

One embodiment of a system of the present disclosure can be implemented as follows. A plurality of wall blocks are stacked to form at least a portion of a retaining wall, each wall block having an interior face, an exterior face; a top surface, and a bottom surface. The system further includes retaining means for securing at least one reinforcement member between stacked wall blocks, the retaining means including a pair of reinforcement member retaining bars that are positioned within a slot crossing the transverse length of the top surface of at least one wall block. A first of the retaining means secures the at least one reinforcement member against the bottom of the slot and a second of the retaining means secures the first retaining members against the side of the slot, such that the at least one reinforcement member is additionally secured between the pair of retaining means. Other systems and methods are also provided.

18 Claims, 19 Drawing Sheets

MODULAR BLOCK CONNECTING TECHNIQUES

CROSS-REFERENCE TO RELATED APPLICATIONS

This application is related to copending U.S. utility patent application entitled "MODULAR BLOCK STRUCTURES" filed on the same date as the present application and accorded Ser. No. 11/273,117, which is entirely incorporated herein by reference, and copending U.S. utility patent application entitled "MODULAR BLOCK ANCHORING TECHNIQUES" filed on the same date as the present application and accorded Ser. No. 11/272,652, which is entirely incorporated herein by reference.

TECHNICAL FIELD

The present disclosure is generally related to earth reinforcement and, more particularly, is related to modular retaining wall structures.

BACKGROUND

Modular earth retaining walls are commonly used for architectural and site development applications. Such walls are subjected to very high pressures exerted by lateral movements of the soil, temperature, and shrinkage effects, and seismic loads. Therefore, backfill soil typically must be braced with tensile reinforcement members. These reinforcement members typically extend rearwardly from the wall and into the soil. The weight of the soil constrains the reinforcement members from lateral movement to thereby stabilize the retaining wall. A variety of retaining wall structures and reinforcement systems exist, such as those disclosed in U.S. Pat. No. 5,921,715, which is entirely incorporated herein by reference; U.S. Pat. No. 6,322,291 B1, which is entirely incorporated herein by reference; U.S. Pat. No. 6,338,597 B1, which is entirely incorporated herein by reference; U.S. Pat. No. 6,416,257 B1, which is entirely incorporated herein by reference; U.S. Pat. No. 6,652,196, which is entirely incorporated herein by reference; U.S. Pat. No. 6,612,784 B2, which is entirely incorporated herein by reference; and U.S. Pat. No. 6,758,636 B2, which is entirely incorporated herein by reference. Although several different forms of reinforcement members have been developed, opportunities for improvement remain with respect to attachment of the reinforcement members to blocks in the retaining wall systems.

SUMMARY

Embodiments of the present disclosure provide systems and methods for a modular wall block system. Briefly described, one embodiment of the system, among others, can be implemented as follows. A plurality of wall blocks are stacked to form at least a portion of a retaining wall, each wall block having an interior face, an exterior face; a top surface, and a bottom surface. The system further includes retaining means for securing at least one reinforcement member between stacked wall blocks, the retaining means including a pair of reinforcement member retaining bars that are positioned within a slot crossing the transverse length of the top surface of at least one wall block. A first of the retaining means secures the at least one reinforcement member against the bottom of the slot and a second of the retaining means secures the first retaining members against the side of the slot, such that the at least one reinforcement member is additionally secured between the pair of retaining means.

Embodiments of the present disclosure can also be viewed as providing methods for forming a modular retaining wall. In this regard, one embodiment of such a method, among others, can be broadly summarized by the following steps: providing a plurality of wall blocks, each wall block having an exterior face and an interior face, and top and bottom surfaces laying between the exterior and interior faces, a transverse channel being formed in the top surface of each wall block and at least one locking means being formed on the top surface of each wall block; positioning a plurality of the blocks to define a lower tier of blocks such that the transverse channel of respective blocks are in alignment; placing at least one reinforcement member on the top surfaces of wall blocks in the lower tier, with the at least one reinforcement member extending from about the exterior faces of the associated wall blocks in the lower tier, down into the transverse channels of the associated wall blocks in the lower tier, past the interior faces of the associated wall blocks, and onto the soil to be reinforced behind the wall; and positioning a pair of reinforcement member retaining bars in the transverse channels of the associated wall blocks in the lower tier, a first retaining bar of the pair securing the at least one reinforcement member against the bottom of the transverse channel and the second retaining bar securing the first retaining bar against a side of the transverse channel, the second retaining bar additionally securing a portion of the reinforcement member against the first retaining bar.

Other systems, methods, features, and advantages of the present disclosure will be or become apparent to one with skill in the art upon examination of the following drawings and detailed description. It is intended that all such additional systems, methods, features, and advantages be included within this description and be within the scope of the present disclosure.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1:
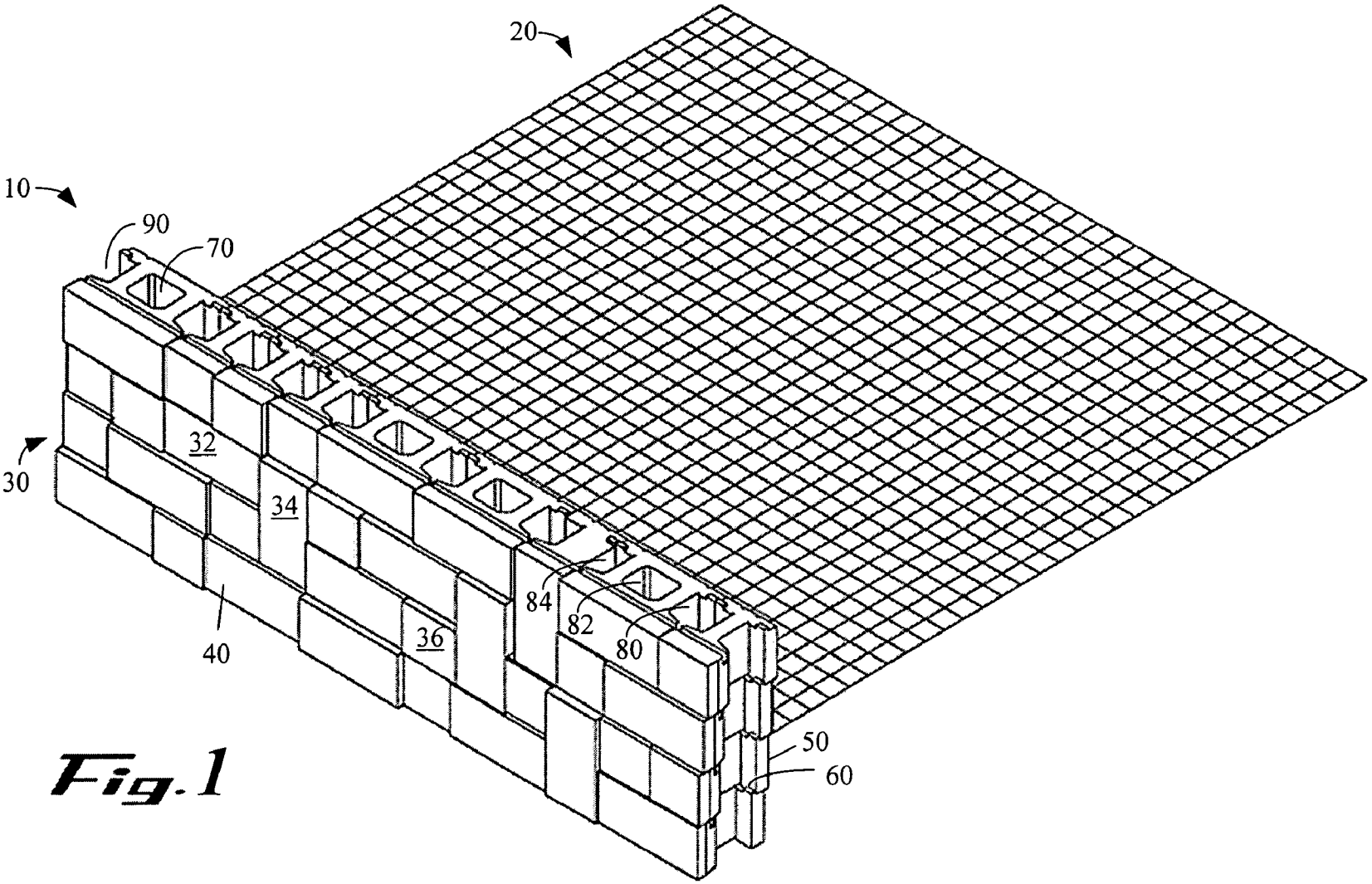
FIG. 1 is a diagram of one embodiment of a modular retaining wall secured with a first embodiment of an anchoring system constructed in accordance with the present disclosure.

Referring now in detail to the drawings, in which like numerals indicate corresponding parts throughout the several views, FIG. 1 illustrates a modular or segmental retaining wall 10 secured with a first embodiment of an anchoring system constructed in accordance with the present disclosure. As depicted in this figure, the retaining wall 10 comprises a plurality of wall blocks 30 that are stacked atop each other. The wall blocks 30 together form an exterior surface 40 of the wall 10 which faces outwardly away from an earth embankment, and an interior surface 50 of the wall 10 which faces inwardly toward the embankment. Typically, the blocks 30 are stacked in a staggered arrangement as shown in FIG. 1 to provide greater stability to the modular retaining wall 10 and to provide ornamental decoration.

Modular or segmental retaining walls commonly comprise courses or tiers of modular units or blocks. The blocks are typically made of concrete. The blocks are typically dry-stacked (no mortar or grout is used), and often include one or more features adapted to properly locate adjacent blocks and/or courses with respect to one another, and to provide resistance to shear forces from course to course. The weight of the blocks is typically in the range of ten to one hundred fifty pounds per unit. Modular retaining walls commonly are used for architectural and site development applications. Such walls are subjected to high loads exerted by the soil behind the walls. These loads are affected by, among other things, the character of the soil, the presence of water, temperature and shrinkage effects, and seismic loads. To handle the loads, modular retaining wall systems often comprise one or more layers of soil reinforcement material extending from between the tiers of blocks back into the soil behind the blocks.

Generally speaking, the modular blocks 30, in one embodiment, are comprised of, but not limited to, three blocks of different size and shape. In one configuration, each block is configured so as to mate with at least one other block when the blocks are stacked atop one another to form the modular retaining wall 10. This mating restricts relative movement between vertically adjacent blocks in at least one horizontal direction and allows adjacent courses to be setback from one another. To provide for this mating, the blocks 30 can include locking means 60, such as a raised notch or node, that secure the blocks together to further increase wall stability.

When the blocks 30 are placed atop each other and adjacent to each other, a continuous elongated passageway or vertical passageway 80 is formed through openings 70 and sides, including side channels or gaps 90, of stacked blocks 30. One of the attributes of this arrangement is that no matter what sequence the 3 types of blocks are placed or stacked, there is always a vertical passageway 80 that extends from the top of the wall 10 to the bottom for each opening formed by side gaps 90 and openings 70 of neighboring blocks. For example, in FIG. 1, more than one vertical passageway 80, 82, 84 is evident in this particular configuration.

As described below, one or more vertical passageways 80 may be used for anchoring system attachment and for stabilizing the modular retaining wall 10 in a vertical or longitudinal direction.

Figure 2:
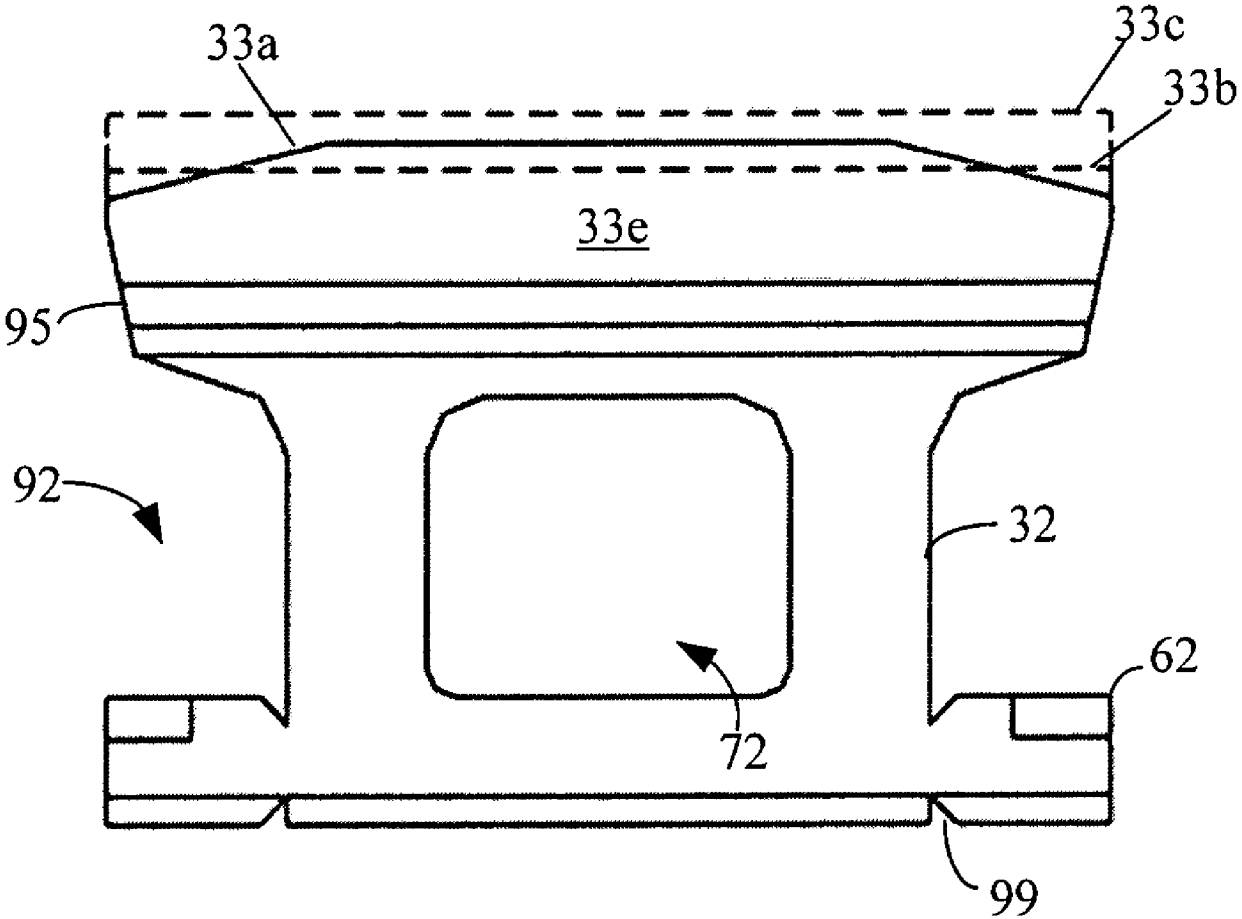
FIG. 2 is a diagram of a top view of one embodiment of a long horizontal block that is utilized in the modular retaining wall of FIG. 1.

As demonstrated in FIG. 1, one type of modular block used in an embodiment of the disclosure is a "long horizontal block" or a standard block 32. FIG. 2 shows a top view of the long horizontal block 32. As shown, the long horizontal block includes side channels 92 and an interior opening or cavity 72 that extends through the block vertically (top-to-bottom). The side channels 92 and interior opening 72 of the wall block 32 reduces the amount of concrete or other materials needed to fabricate the block 32 and reduce the weight of the block 32 to simplify wall construction. The opening 72 of the wall block 32 is sized so as to maximize the strength of the block 32 while still permitting space for connecting anchoring structures to the wall 10, in some embodiments.

Further, locking means 62 are shown for securing another block positioned vertically atop the block 32. In accordance with the present disclosure, a variety of faces of the block may be used to provide a different texture and design to the wall. As represented by the solid line 33*a* in the figure, the long horizontal block may feature a multiple sides or multi-split configuration. Alternatively, in some embodiments, as represented by the dashed lines 33*b*, 33*c*, the face may feature offset splits, where one version of the block 32 has a face that is flush with line 33*b* and another version of the block 32 has a face that is flush with line 33*c*. Therefore, if these two versions of the block 32 are used in the same wall, the wall has a multi-textured appearance. In other embodiments, a segmental wall may be made from blocks of one type and version, such as a standard block 32, where the faces of the block are flush with each other, as they are stacked. In some embodiments, one or more notches 99 are formed in the block 32 to aid in removal of a rear portion of the block 32 by brute and blunt force (e.g., using a hammer).

Figure 4:
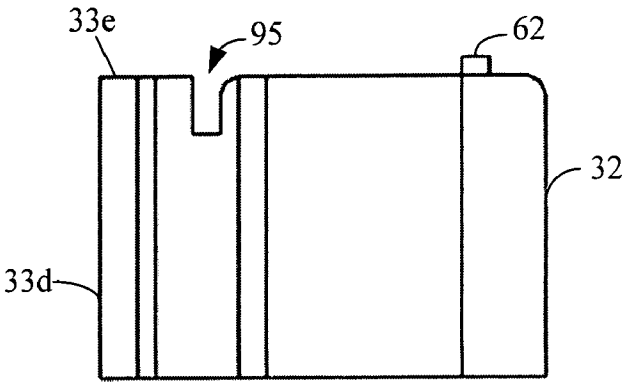
FIG. 4 is a diagram of a side view of the long horizontal block of FIG. 2.
Figure 3:
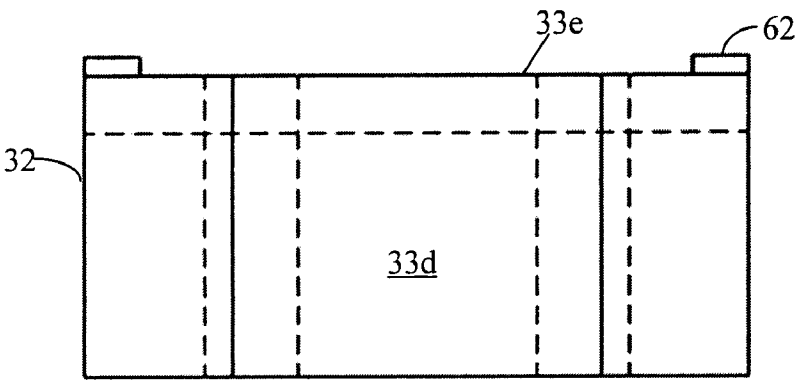
FIG. 3 is a diagram of a front view of the long horizontal block of FIG. 2.

Next, FIG. 3 shows a front view of the long horizontal block 32. In this view, the front face 33*d* and top surface 33*e* of the block is shown in relation to the locking means 62. Accordingly, FIG. 4 displays a side view of the long horizontal block 32.

In this view, the locking means 62 is shown in relation to the front face 33*d* and a lateral alignment slot 95. The lateral alignment slot or channel 95 is a narrow channel extending inwardly into the block 32 from the top surface 33*e*. The lateral alignment slot 95 receives one or more elongated rods generally during installation of an anchoring system 20 for aligning adjacent blocks 30 and stabilizing the wall structure.

Figure 5:
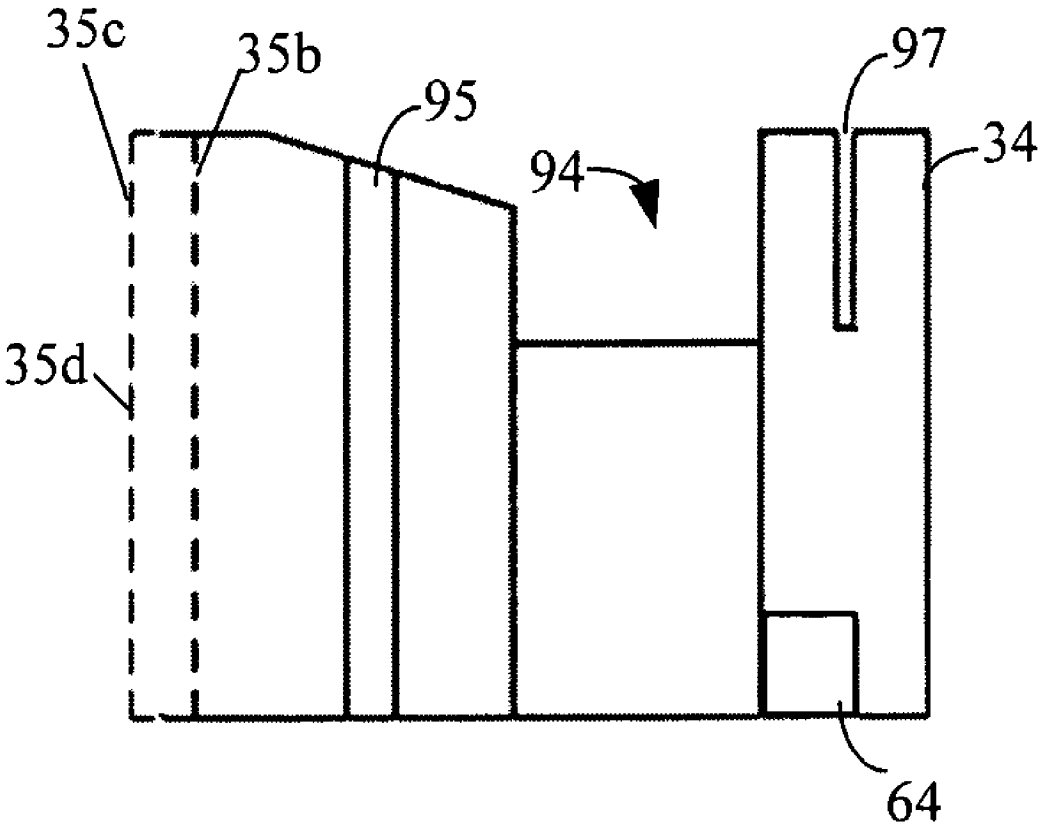
FIG. 5 is a diagram of a top view of one embodiment of a long vertical block that is utilized in the modular retaining wall of FIG. 1.

As demonstrated in FIG. 1, another type of modular block used in an embodiment of the disclosure is a "long vertical block" 34 which may be utilized with the long horizontal block 32 to form a retaining wall 10. FIG. 5 shows a top view of the long vertical block 34. As shown, the long vertical block 34 includes a side channel 94, a locking means 64, and a lateral alignment slot or channel 95. A variety of faces of the block 34 may used to provide a different texture and design to the wall. In some embodiments, as represented by the dashed lines 35*b*, 35*c*, the face of different versions of the block 34 may feature offset splits. In this way, a wall featuring the different versions of the block 34 will have a multi-textured appearance. In some embodiments, the long vertical block 34 also features a groove 97 along one side of the rear portion of the block 34. This allows an installer to hit the rear portion of the block featuring the groove 97 to break off the rear portion of the wall block containing the groove 97. For example, by removing this portion of the block 34, the long vertical block may be used to make an inside curve of a wall arrangement, as discussed further below.

Figure 6:
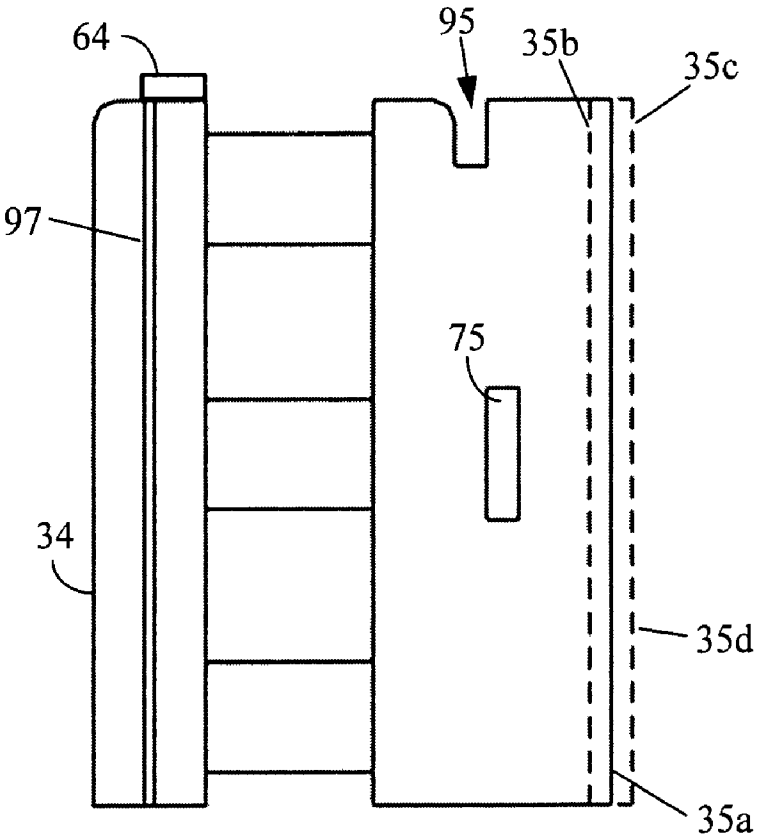
FIG. 6 is a diagram of a side view of the long vertical block of FIG. 5.

Next, FIG. 6 shows a side view of the long vertical block 34. In this view, the front face 35*d* of the block 34 is shown in relation to the locking means 64, lateral alignment slot 95, and groove 97. Also, shown is an interior slot 75 extending through the block 34 horizontally from one side of the modular block 34 to the other side. The interior slot 75 may be aligned with a lateral alignment slot of an adjacent block and/or an interior slot of an adjacent block and receive one or more elongated rods for aligning adjacent blocks 32, 34, 36.

Figure 7:
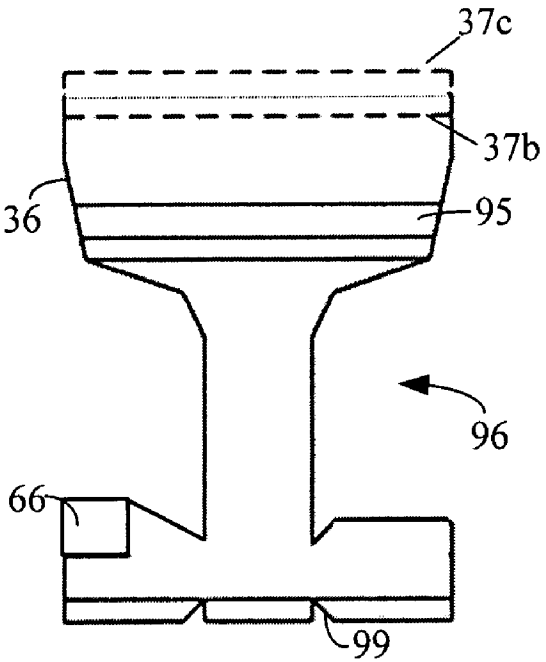
FIG. 7 is a diagram of a top view of one embodiment of a half block that is utilized in the modular retaining wall of FIG. 1.

Further, another type of modular block used in an embodiment of the disclosure is a "half block" 36. As shown in FIG. 1, the half block 36 may be used in a variety of patterns with the long horizontal block 32 and long vertical block 34 to form a modular retaining wall 10. FIG. 7 shows a top view of the half block 36. As shown, the half block includes side channels 96, locking means 66, notches 99, and a lateral alignment slot 95. A variety of faces of the block 36 may used to provide a different texture and design to a modular retaining wall. As represented by the dashed lines 37*b*, 37*c*, faces of different versions of the block 36 may feature offset splits, in some embodiments.

Figure 8:
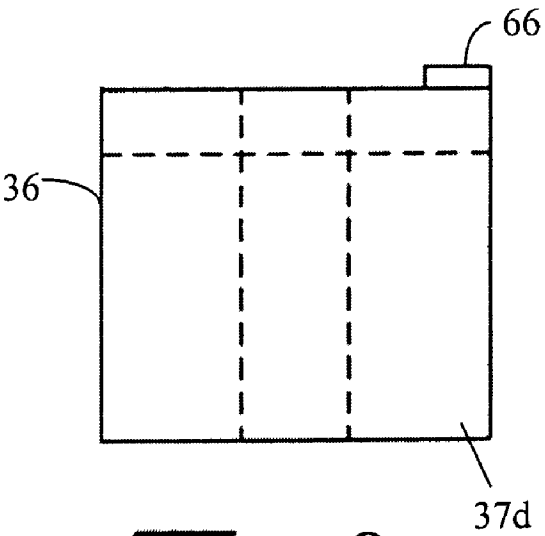
FIG. 8 is a diagram of a front view of the half block of FIG. 7.
Figure 9:
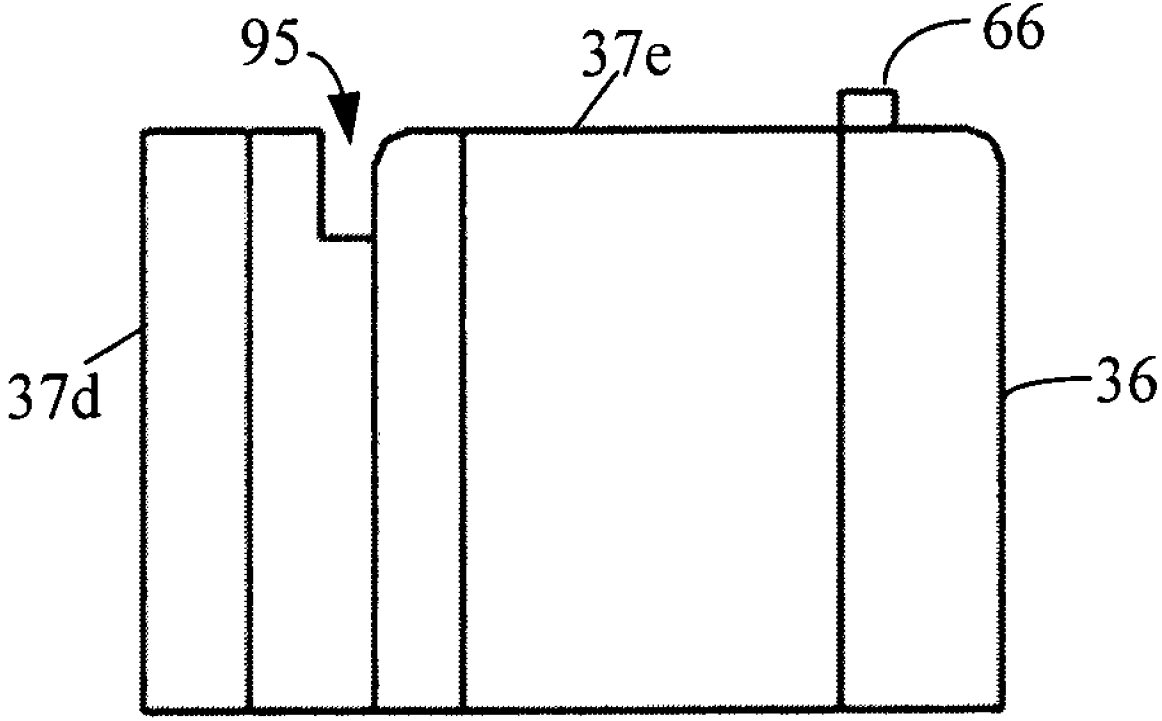
FIG. 9 is a diagram of a side view of the long horizontal block of FIG. 7.

Next, FIG. 8 shows a front view of the half block 36. In this view, the front face 37*d* of the block is shown along with the locking means 66. Accordingly, FIG. 9 displays a side view of the half block 36. In this view, the locking means 66 is shown in relation to the front face 37*d* and a lateral alignment slot 95. The lateral alignment channel 95 is a narrow channel extending inwardly into the block 36 from the top surface 37*e*. As previously mentioned, the lateral alignment channel 95 may receive one or more elongated rods for aligning adjacent blocks 32, 34, 36 and for stabilizing the wall structure 10 with installation of an anchoring system.

Figure 10:
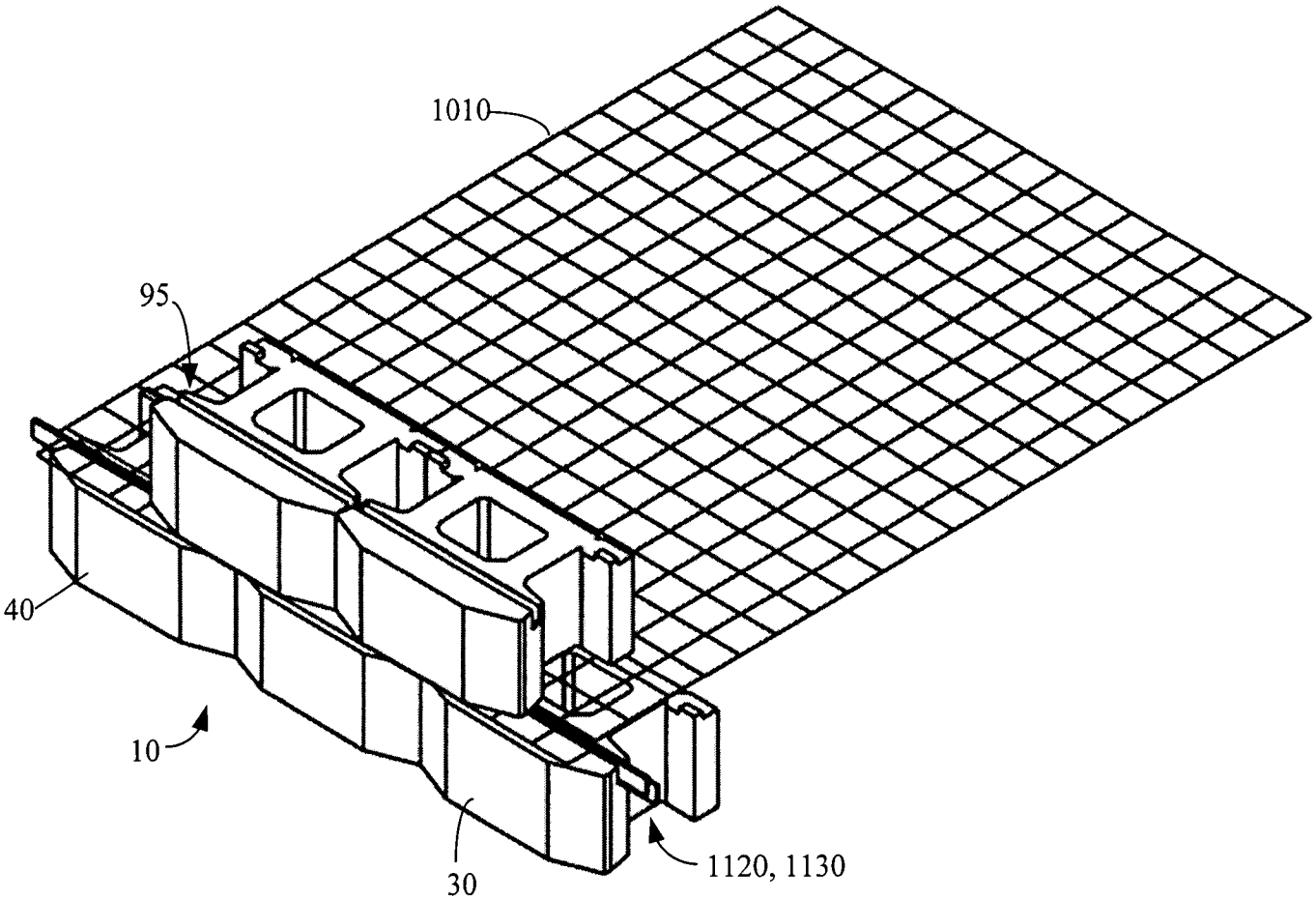
FIG. 10 is a diagram of a perspective view of one embodiment of an anchoring system constructed in accordance with the present disclosure.

FIG. 10 illustrates an embodiment 20 of an anchoring system constructed in accordance with the present disclosure. In this particular example, a retaining wall 10 is constructed with, but not limited to, standard blocks 32 with a multi-split face. As shown most clearly in FIG. 10, a reinforcement member 1010 extends from the exterior surface 40 of the retaining wall 10 into a lateral alignment slot 95 of the wall blocks 30, out from the wall 10, and into a portion of an embankment. In particular, the reinforcement member 1010 exemplary comprises a geogrid material in a lattice arrangement that comprises fabric composed of a polymeric material such as polypropylene or high tenacity polyester. These reinforcement members 1010 typically extend rearwardly from the wall 10 and into soil of the embankment to stabilize the soil against movement and thereby create a more stable soil mass which results in a more structurally secure retaining wall 10. As a general proposition, the more efficient the connection between the geogrid material and individual blocks of the modular retaining wall 10, the fewer the layers of geogrid material that should be required in the wall system. The cost of reinforcing grid can be a significant portion of the cost of the wall system, so highly efficient block/grid connections are desirable.

As mentioned above, the wall blocks 30 comprise a lateral alignment slot for 95 attaching reinforcement members 1010 (e.g., geogrid) to the retaining wall 10. When the lateral alignment slot 95 is provided in the top surface as illustrated in FIGS. 11 and 12, the lateral alignment slot 95 preferably extends transversely across the block 30 from one side of the block to the other, usually parallel to the interior surface of the block.

Figure 12:
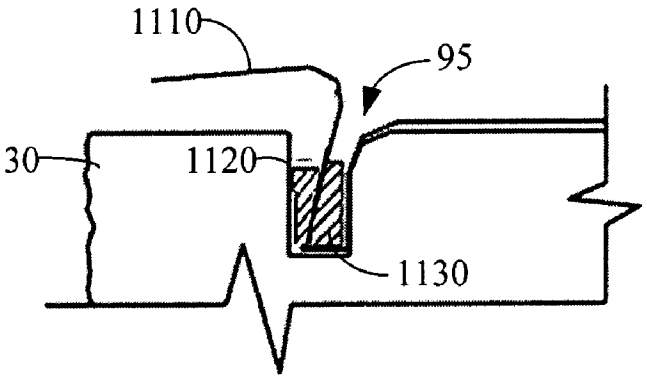
FIGS. 11-12 are diagrams of a side view of a modular block with a reinforcement member being secured within a lateral alignment slot of the modular block in accordance with FIG. 10.
Figure 11:
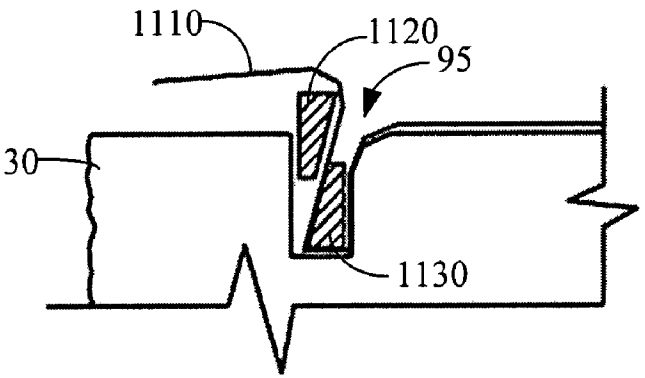

In some embodiments, to secure the reinforcement members 1010 in the lateral alignment slot 95, a portion of the reinforcement member 1010 is positioned within the lateral alignment slot 95 and secured in place by two retaining members 1120, 1130, as indicated by FIGS. 11 and 12. The retaining members 1120, 1130 are securely held within the lateral alignment slot 95 and, in turn, securely holds the reinforcement member 1110 in place. The retaining members 1120, 1130 are wedge-shaped (and/or trapezoidal-shaped) and when aligned correctly within the lateral alignment slot 95, each contacts the front and rear walls of the lateral alignment slot 95, as indicated in FIGS. 11 and 12. In particular, FIG. 11 demonstrates the retaining members 1120, 1130 being placed into the lateral alignment slot 95 to secure a geogrid material 1110, such that the geogrid material 1110 is positioned outside the exterior of each retaining member and against the wall of the alignment slot 95 closest to the embankment. The placement of the double wedge-shaped retaining members 1120, 1130 within the lateral alignment slot 95 locks the geogrid material 1110 within the lateral alignment slot 95.

Further, FIG. 12 demonstrates the positioning of the retaining members 1120, 1130 within the lateral alignment slot 95 such that the geogrid material 1110 is secured by the placement of the retaining members 1120, 1130 against the front and rear walls of the lateral alignment slot 95. As such, when a tensile load is applied to the reinforcement member 1110, the retaining members 1120, 1130 prevent the reinforcement member 1110 from being pulled out from the retaining wall 10. More specifically, when a tensile force is applied to the reinforcement member 1110 from the soil side of the retaining wall 10, the retaining member 1120, 1130 or bar closest to the embankment is pushed against the inner wall of the lateral alignment slot 95 thereby also clamping the reinforcement material (e.g., geogrid material) 1110 between the inner wall and the retaining member 1120, 1130. Further, the retaining member 1120, 1130 closest to the embankment is being clamped in place by the forces applied against the member by the other retaining member 1120, 1130 secured by the other wall of the lateral alignment slot. For further illustration, FIG. 10 also shows a perspective view of the anchoring system utilizing the pair of retaining members 1120,1130 to secure geogrid material in the lateral alignment slots 95 of a series of blocks 30.

Figure 13:
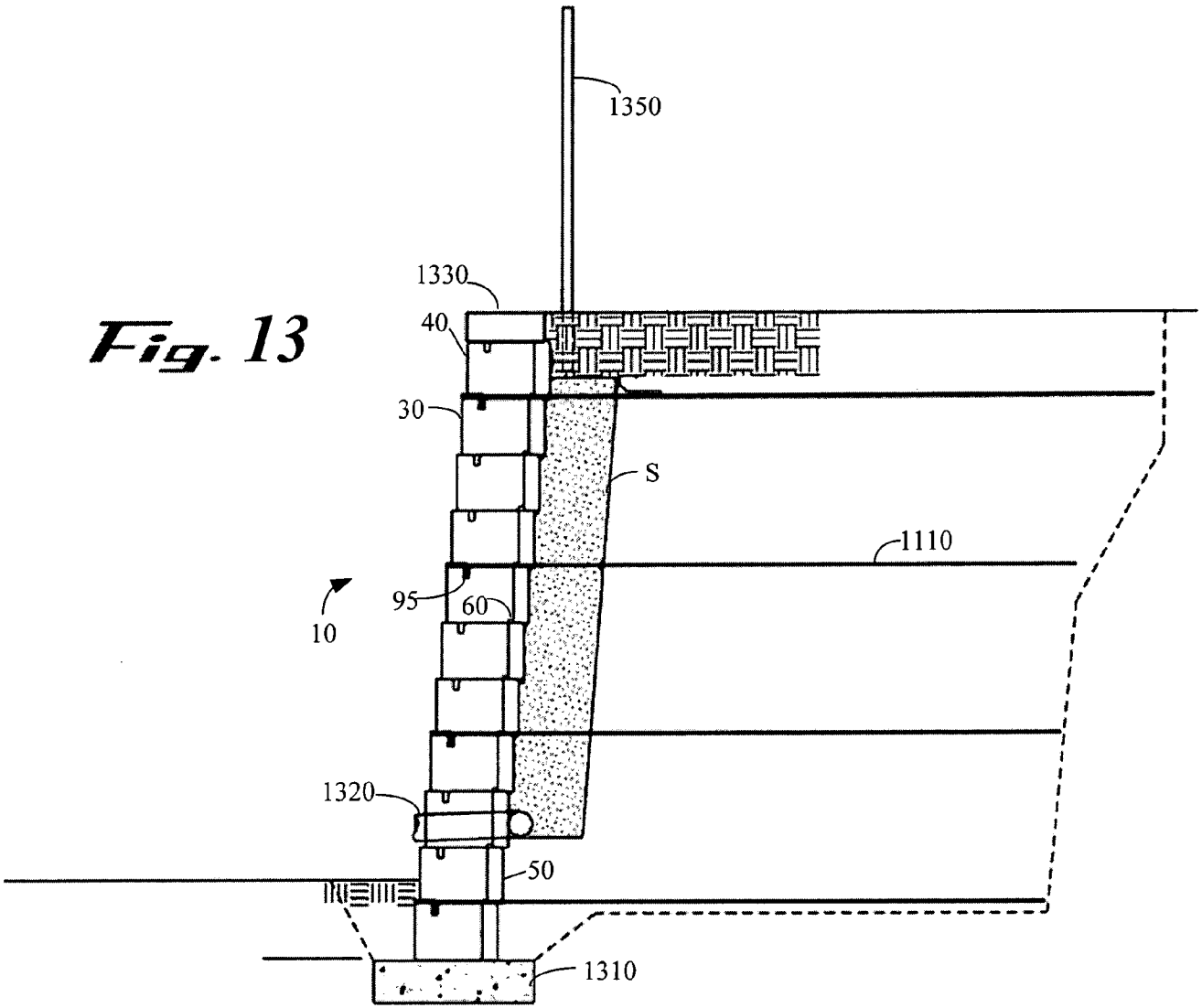
FIG. 13 is a diagram of a side view of one embodiment of a modular retaining wall utilizing the anchoring system of FIG. 10.

One embodiment of the system of the present disclosure can be used to construct any number of different configurations of modular or segmental retaining walls. FIG. 13 illustrates one example of such a retaining wall 10. To construct such a wall 10, a leveling pad 1310 is normally laid to provide a foundation upon which to build the wall 10. Typically, this leveling pad 1310 comprises a layer of compacted, crushed stone that is embedded under the soil to protect the wall foundation. Once the leveling pad 1310 is laid and compacted, a plurality of blocks are aligned along the length of the pad 1310. Preferably, each of the blocks is provided with a lateral alignment slot 95 in its top surface, if each of the blocks are of a standard type. However, in some embodiments, blocks of different shapes and sizes may be used where the blocks feature lateral alignment slots 95 and interior slots 75 that are aligned to engage retaining members 1120, 1130 or other structures, such as a rebar rod across the horizontal length of a wall 10.

For example, as shown in FIG. 1, an optional configuration utilizing different blocks of different shapes and sizes and a random-like pattern, is also able to utilize the geogrid anchoring system 20 utilizing retaining members 1120, 1130, as previously described. Advantageously, a reinforcement member may be attached to any row or course of the wall 30, since the vertical block 34 has an interior slot 75 that aligns with the lateral alignment slot 95 or interior slot 75 of neighboring blocks. In an instance where a reinforcement material is attached using lateral alignment slots 95, the reinforcement material may be cut or configured to lay near or against a vertical block 34 that does not have a lateral alignment slot.

After the first set of blocks has been formed, additional blocks 30 can be laid on top of the first set of blocks. Further, geogrid material 1110 can be used to anchor the wall into the embankment. In the example shown, geogrid reinforcement 1110 is provided after a series of blocks have been placed on top of one another. As can be appreciated from FIG. 13, and with reference to FIGS. 1-8, the bottom rear surface of a block mates with the top rear surface of a block underneath it. In particular, the locking means 60 of a block mates with the bottom of a block that is placed on top of the locking means, to secure the block on top from moving forward. This mating relationship holds the wall block 30 in place atop of lower blocks and prevents the wall blocks 30 from tipping forward, thereby providing integral locking means 60 for the blocks 30.

Once a series of wall blocks have been formed across the intended length of the wall, backfill soil, S, can be placed behind the blocks 30. Typically, a non-woven filter fabric is provided between the wall 10 and the backfill soil to prevent the introduction of particulate matter between the tiers of blocks 30 due to water migration within the soil. Alternatively, a layer of gravel aggregate can be provided between the wall and the soil to serve the same function. Additional ascending tiers thereafter are then laid in the manner described above. Although alternative configurations are possible, a reinforcement member 1110 typically is laid after three or four blocks have been laid vertically on top of one another, where alignment of adjacent blocks is an inherent feature of the system due to the design of the wall blocks, as indicated in FIG. 13. It will be appreciated, however, that greater or fewer reinforcement members 1110 can be provided depending upon the particular reinforcement needs of an installation site. As described above, the reinforcement members 1110 are positioned so that they extend from the exterior surface 40 of the retaining wall 10, into the lateral alignment slot 95, and past the interior surface 50 of the retaining wall 10 to extend into the soil. A pair of reinforcement member retaining bars 1120, 1130 are placed on top of the reinforcement member 1110 in the lateral alignment slot 95 to secure the reinforcement member 1110 with the wall 10.

Construction of the retaining wall 10 continues in this manner until the desired height is attained. As indicated in FIG. 13, the setback of the wall blocks 30 creates a net inward setback appearance of the retaining wall 10. Additionally, the configuration of the blocks 30 creates an aesthetically pleasing stepped appearance for the exterior surface 40 of the wall 10. Where the full height of a wall block 10 is unnecessary or not desired, short wall blocks (not shown) can be used to form the top or other course, and cap blocks 1330 can be used to complete the wall 10. The cap blocks 1330 can be fixed in position with concrete adhesive and provided with an ornamental pattern similar to the exterior faces of the blocks, if desired. Additionally, a subsurface collector drain 1320 can be provided within the backfill soil S to remove excess water collected therein.

Figure 14:
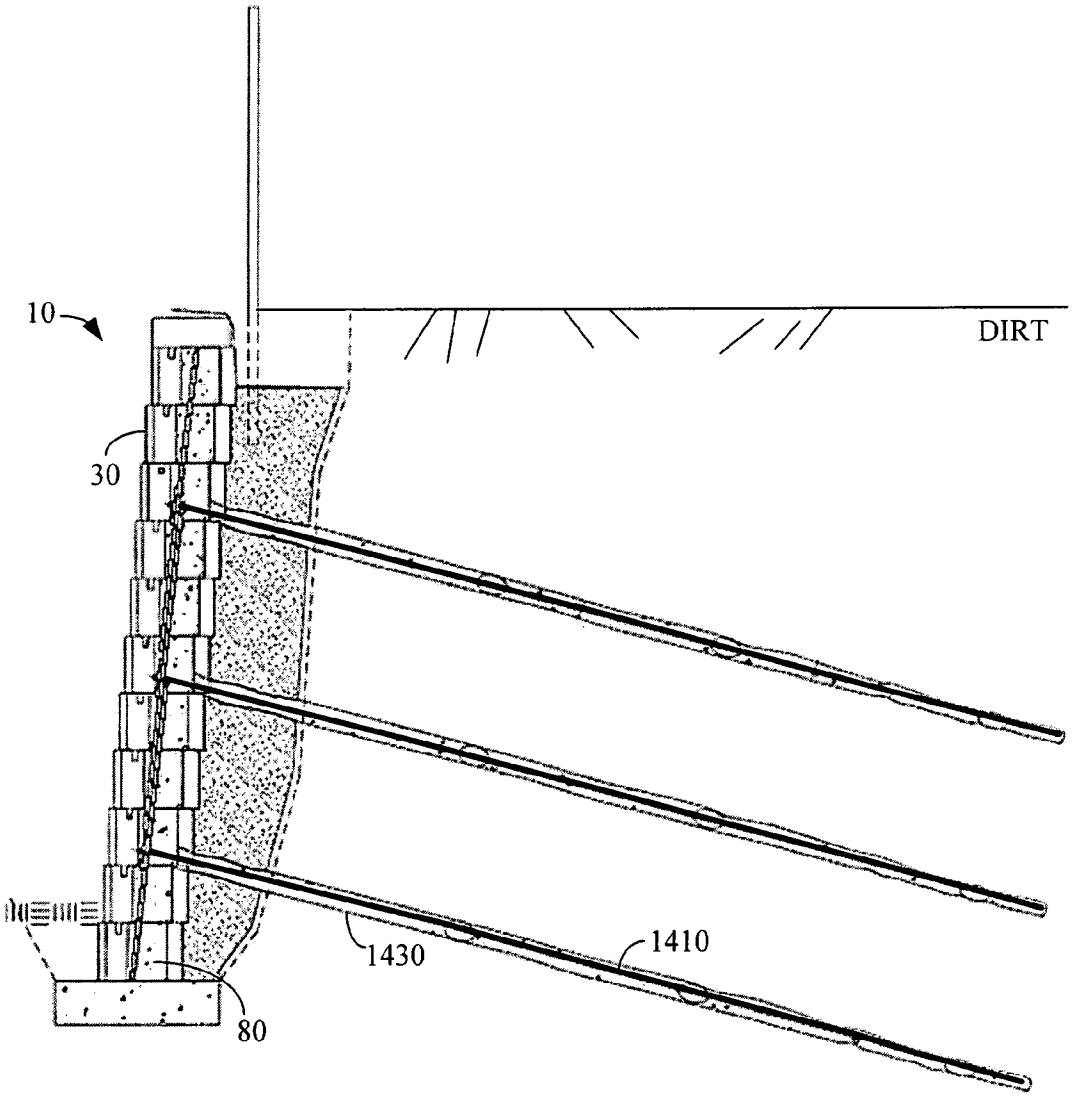
FIGS. 14-15 are diagrams of a side view of one embodiment of an anchoring system constructed in accordance with the present disclosure.

In accordance with the present disclosure, another embodiment of an anchoring system for securing a retaining wall is shown with respect to FIG. 14. In this example, the retaining wall 10 is secured in several predetermined points with tieback connections. As shown in FIG. 14, each tieback rod 1410 (e.g., having a 4" or 6" diameter) extends through an opening 1430 formed in the rear surface of its respective wall block 30 such that a proximal portion of the rod 1410 extends into the continuous elongated passageway 80. In some embodiments, the opening 1430 is created by using a hammer to knock off one of the sides, thereby not requiring the use of a saw to cut a hole. Advantageously, in some other embodiments, the rear portion of the block may be knocked of with a hammer with aid of notches 99 or grooves formed into the rear portion that help in removing of the portion being hit by the hammer. Subsequently, concrete is added in the vicinity of the removed portion of the block to cover the tieback rod 1410, as explained below.

As can be seen in FIG. 14, a plurality of tieback rods 1410 extend laterally from the face of an embankment. Each of the tieback rods 1410 is secured in the earth with conventional anchors (not shown). Accordingly, each tieback rod 1410 is embedded into the soil and/or rock in these intervals.

Figure 15:
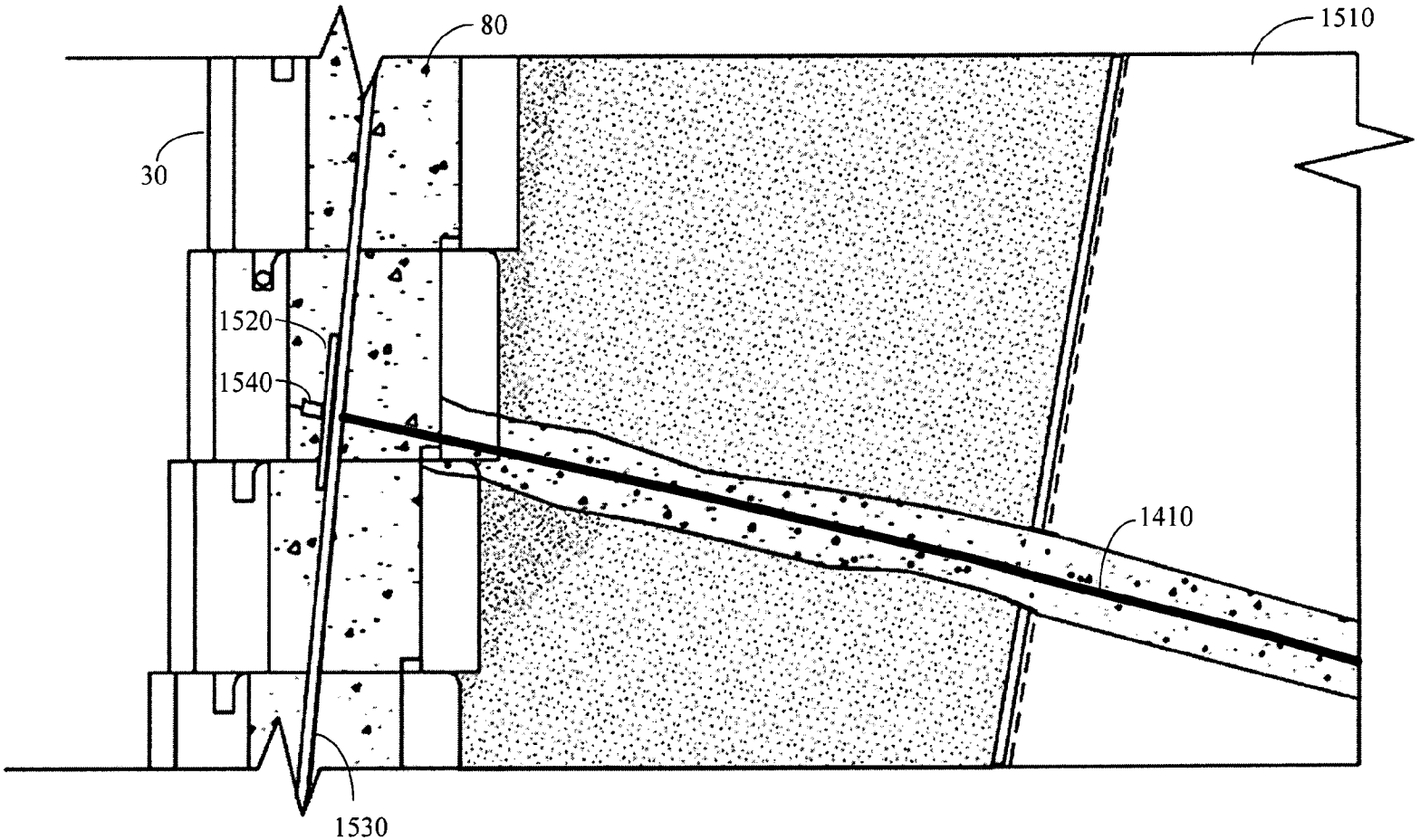

FIG. 15 provides a closer view of a tieback rod 1410 in relation to the retaining wall 10 and the embankment 1510. As shown in FIG. 15, a tieback rod attachment mechanism 1520 (e.g., ½"×5"×5" steel plate) secures the tieback rod 1410 to the retaining wall 10. The attachment mechanism 1520 normally includes an elongated force distribution member 1530 (e.g., rebar rod) that extends a portion of the vertical height of a continuous elongated passageway 80 or column formed by the surrounding block for one or more tieback rods 1410, as indicated in FIG. 15. The continuous elongated passageway 80 is further encased in concrete after installation. The concrete with the blocks and the elongated force distribution member 1530 create a concrete reinforced beam that helps distribute the pressure from the earth anchor to the rest of the wall. In addition, the concrete protects steel components (such as may be used in the elongated force distribution member 1530, tieback rod 1410, attachment mechanism 1520, etc.) from corrosion or other adverse effects.

Threaded onto each tieback rod 1410 is a conventional threaded fastener 1540 such as a nut which, when encased in concrete in the passageway 80, urges the tieback rod 1410 inwardly to securely hold the attachment mechanism 1520, in position, thereby securing the rod to the wall 10. Normally, the fastener 1540 and attachment mechanism 1520 assembly are accessed via the interior of the elongated passageway 80 before concrete is added. Configured in this manner and once filled with concrete, each tieback connection 1410 evenly distributes any forces exerted on the tieback rods 1410 throughout the wall 10 to greatly improve wall integrity.

Figure 17:
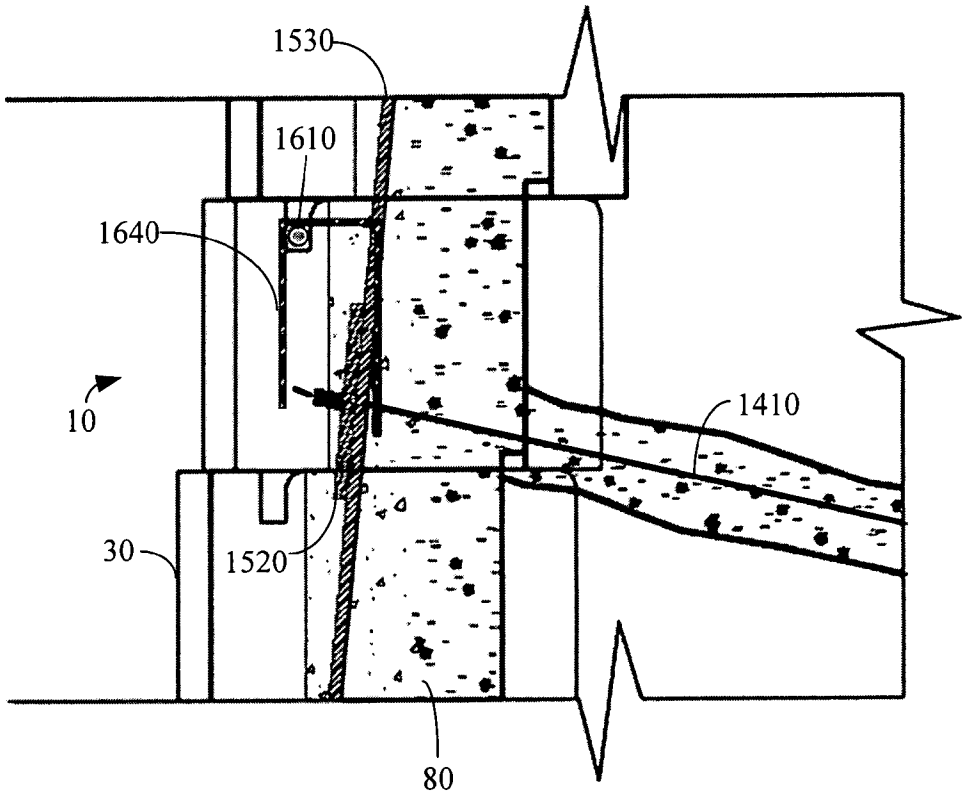
FIG. 17 is a diagram of a side view of a modular retaining wall with an attachment mechanism for securing a tieback rod to the wall in accordance with FIG. 14.
Figure 16:
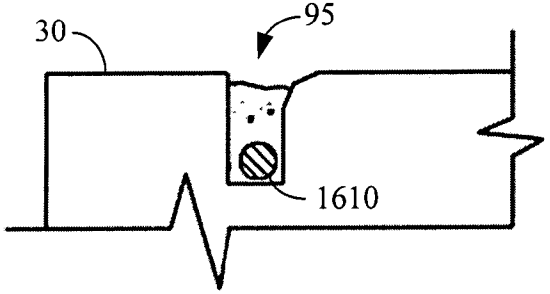
FIG. 16 is a diagram of a side view of a modular block of a modular retaining wall with an elongated rod placed in a lateral alignment slot of the block in accordance with FIG. 14.
Figure 18:
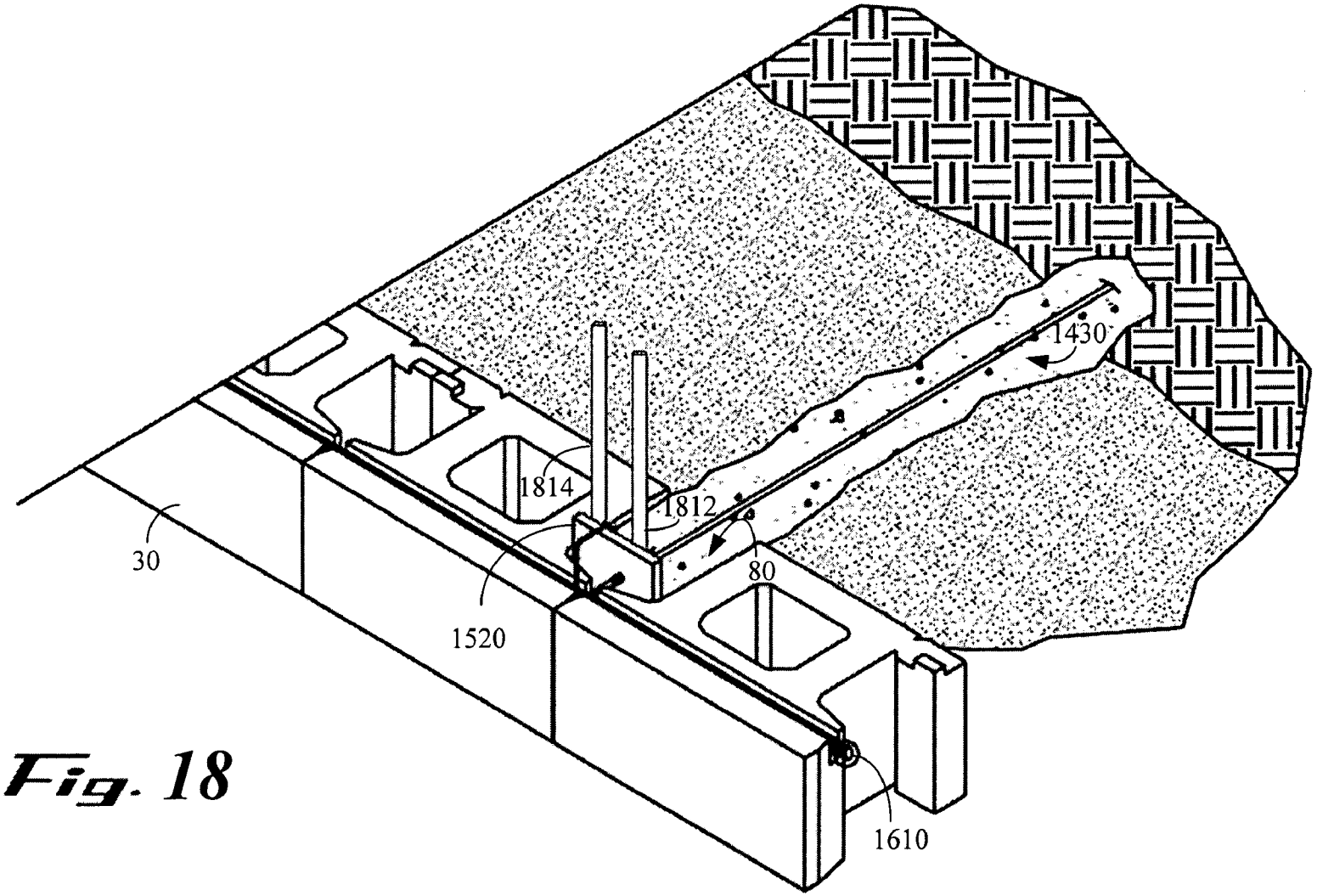
FIG. 18 is a diagram of a perspective view of a portion of a modular retaining wall with vertical support structures being placed in a continuous passageway of the wall in accordance with FIG. 14.

For some embodiments, within the lateral alignment slot 95 of a row of wall blocks 30, a section of a rebar rod 1610 (e.g., #4 epoxy coated rebar) is placed in the slot 95, and the slot is filled with grout (e.g., 3000 PSI high early strength grout) to reinforce the wall 10 from side to side, as illustrated in FIGS. 16-18. In embodiments, where blocks 30 of different shapes and sizes are arranged to form a wall (as generally shown in FIG. 1), the rebar rod 1610 may be passed through an interior slot 75 of a vertical block 34 that is aligned with an interior slot 75 or lateral alignment slot 95 of an neighboring block on any row or course of the a wall structure.

Referring now to FIG. 17, the rebar rod 1610 in the alignment slot 95 acts to secure the attachment mechanism 1520 within the continuous passageway 80. For example, an attachment clamp 1640 (e.g. #4 "U" section of rebar rod), is placed on one side of the rebar rod 1610 and the other side of the attachment mechanism 1520 to clamp the attachment mechanism 1520 to help create a coherent reinforced concrete mass, after the concrete is added.

Further, the blocks 30 on each row of the wall 10 are configured such that the continuous elongated passageway 80 runs through the vertical height of the wall 10 through the plurality of rows of blocks. Accordingly, tieback rods 1410 are positioned vertically atop each other and positioned to the modular retaining wall 10 using a common vertical core or passageway 80, as illustrated in FIG. 14.

Further, with a continuous elongated passageway 80 within the wall 10, sections of rebar or other support structure may be placed within the passageway 80 as the wall 10 is constructed to serve as the elongated force distribution member 1530. For example, as the wall is being built, two rebar rods 1812, 1814 are placed within the continuous passageway, as shown in FIG. 18, and are secured within the passageway 80 with concrete (e.g., 3000-pounds per square in (PSI) concrete). The rebar rods 1812, 1814 also act to secure the attachment mechanism 1520 within the continuous passageway or vertical core.

For some embodiments, as blocks are stacked on top of the rebar support or rods (of which there are two) to a height that reaches the next anchor or tieback rod (e.g., about two to five feet upwards), two additional pieces or sections of rebar support are positioned in the passageway 80 which overlaps with the previous two pieces or sections of rebar support which were placed in the vertical core or passageway 80. After positioning the rebar rods, the passageway 80 is filled with concrete (e.g., 3000-PSI concrete) so that there are two sections of rebar rods jutting out of the top of the continuous passageway 80. In this way, a continuous rebar rod does not have to be used from the bottom of the wall 10 to the top. Further, blocks 30 used to construct the wall also do not have to be lifted to great heights (e.g., 10 to 12 feet) when the blocks are stacked to form a tall wall. Rather, the rebar support 1812, 1814 may be positioned in overlapping increments that are easy to manage. Further, different lengths of rebar rods may be used along the vertical height of a wall structure.

Figure 19:
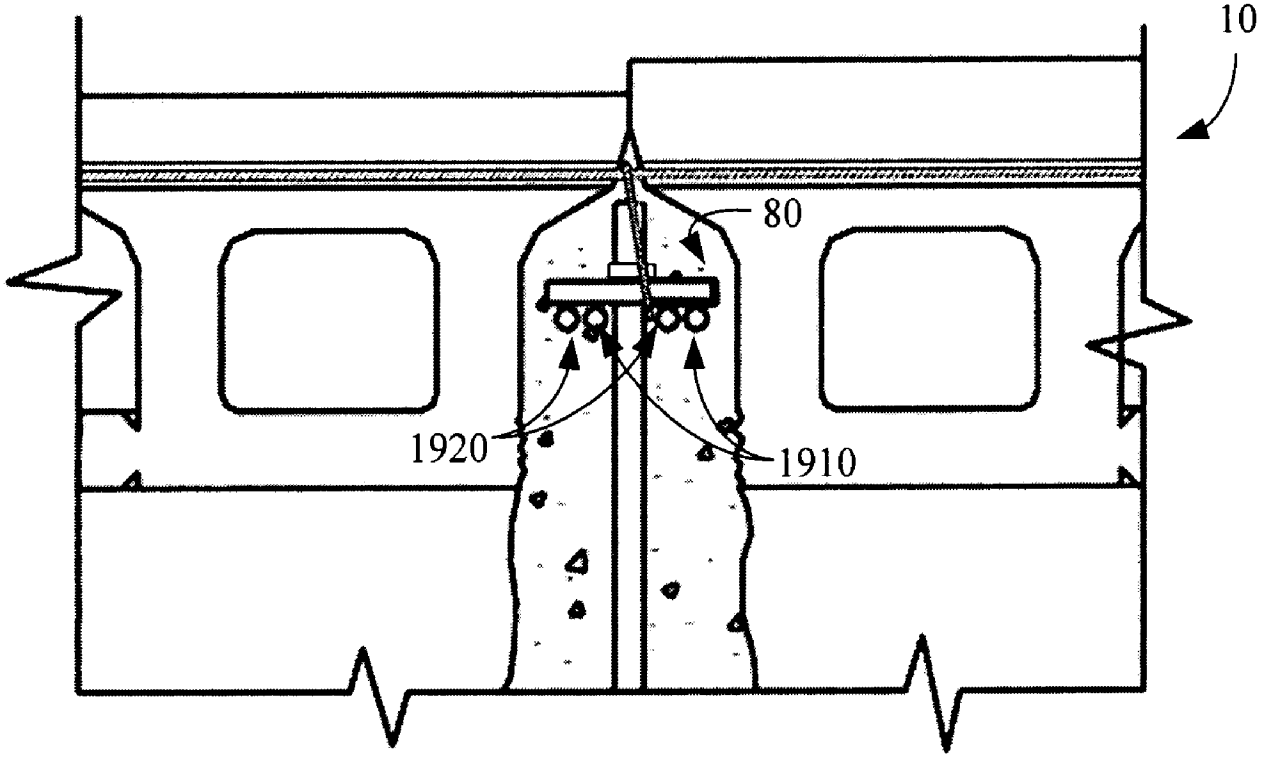
FIG. 19 is a diagram of a top view of a portion of the modular retaining wall of FIG. 18.

The rebar rods 1812, 1814 stand between one anchor or tieback rod and the next. Accordingly, FIG. 19 shows a top view of a portion of a constructed wall. In the figure, one pair of rebar supports 1910 is shown jutting out of the continuous passageway 80 and overlapping a previous positioned pair of rebar supports 1920.

Generally, the tieback rods are spaced on about three to eight foot centers both vertically and horizontally. The concrete filled continuous elongated passageway or column carries the anchor load vertically, and the lateral alignment slot 95 with the rebar filled with grout transfers the load horizontally, as shown in FIG. 14. With the arrangement of the three different blocks 32, 34, 36 within the modular retaining wall structure, 10, a vertical and continuous column 80 is constructed within the wall 10 from the top of the wall to the bottom, as illustrated in FIGS. 14-19. No matter if vertical, half, or horizontal blocks are used, there is always a vertical column 80 running along the full height of the wall that is partially formed by a particular block. The vertical column may be a "full core" 80 formed from adjacent side gaps 92, 94, 96 or interior openings 70, 72 of neighboring blocks or a "half core" 84 partially formed from a side of a vertical block 34 not having a side gap 94 and the gaps, openings, and sides of other neighboring blocks, as generally shown in FIG. 1.

Figure 20:
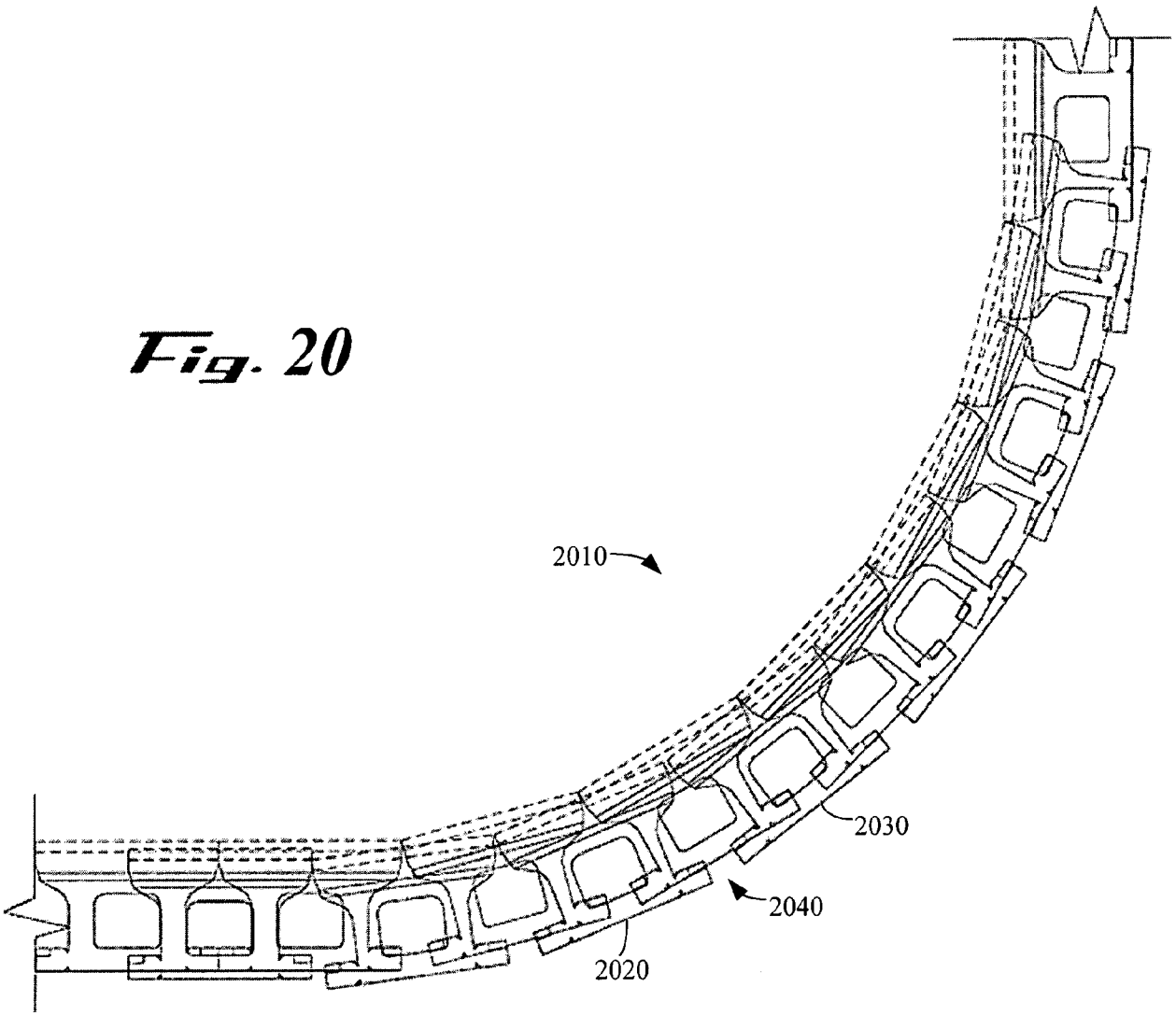
FIG. 20 is a diagram of a top view of a modular retaining wall with a curved shaped that is constructed having a generally uniform inside radius.

In accordance with the present disclosure, exterior faces of the blocks 30 which form the exterior surface 40 of the modular retaining wall 10 may be provided with an ornamental texture or facing to create a visually pleasing facade. Further, blocks 30 may be positioned in a variety of configurations to provide a desired shape and appearance for the wall itself. For example, FIG. 20 shows a top view of a retaining wall 2010 with a curved shaped that is constructed having a generally uniform inside radius curve in wall alignment utilizing standard wall blocks 32. To facilitate formation of the inside radius of the wall, neighboring blocks 2020, 2030 are positioned with a gap 2040 between the rear portion of neighboring blocks 2020, 2030, as shown. In other embodiments, a curved shape of a wall also may arranged of blocks of different shapes and sizes stacked upon each other.

Figure 21:
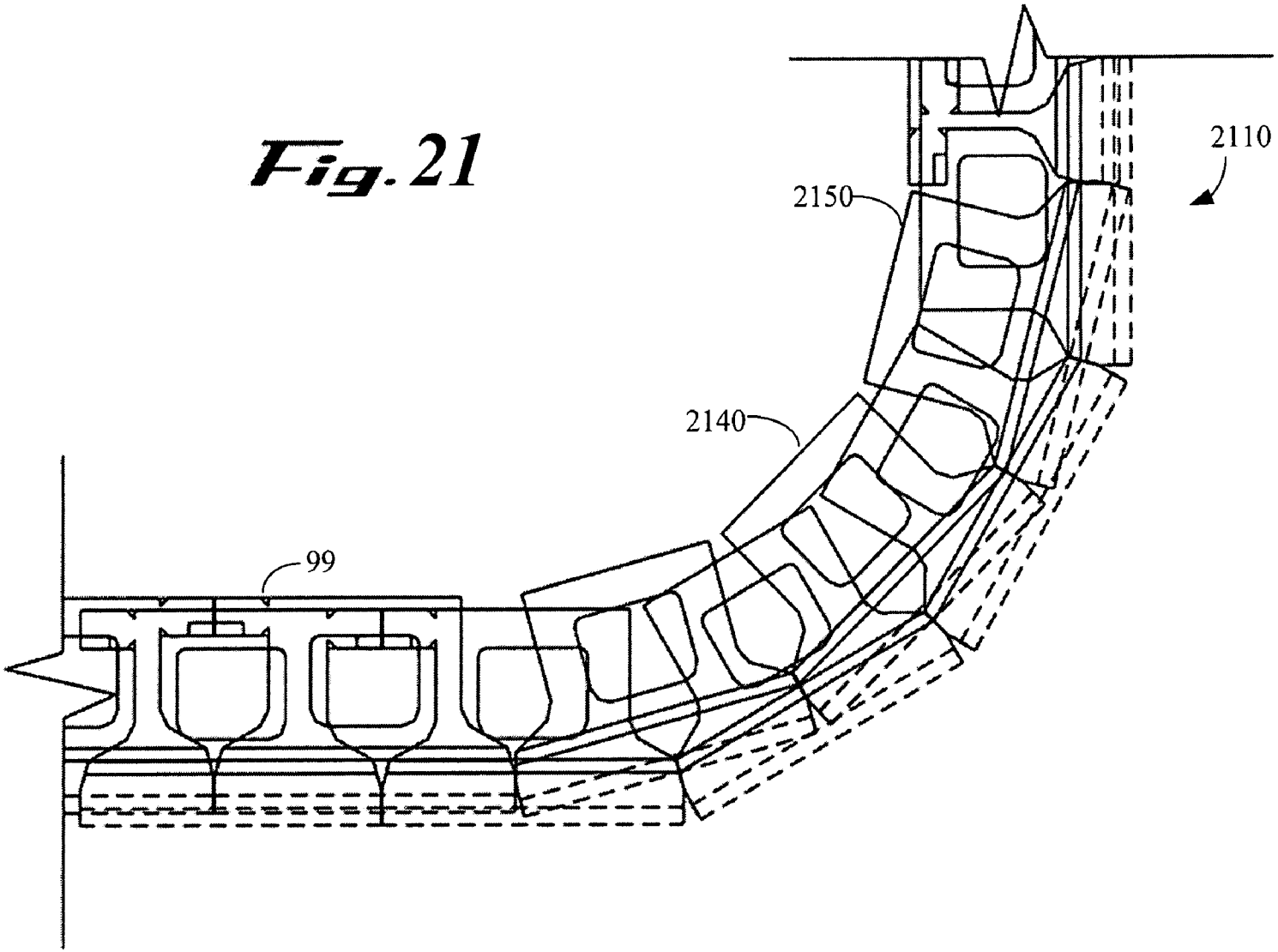
FIG. 21 is a diagram of a top view of a modular retaining wall with a curved shaped that is constructed having a generally uniform outside radius.

Further, FIG. 21 shows a top view of a retaining wall 2110 with a curved shape having a generally uniform outside radius. To facilitate formation of the outside radius of the wall, a portion on one or both sides of the rear of a block are removed (e.g., knocked off with a hammer) so that the neighboring blocks 2140, 2150 may be aligned closely together keeping the faces of neighboring blocks touching (although the rear portions of neighboring blocks may not touch). Gaps left between rear portions of neighboring blocks are filled with stone to fill the void, in some embodiments, and since the faces of the blocks are touching, the stone does not spill out from the front of the wall. In some embodiments, notches 99 are formed in the blocks to aid in removal of rear portions of blocks by a hammer, as shown in FIG. 21. Further, one or more rear nodes 60 are placed on the blocks such that adjacent courses can be still stacked and engaged but allow curves of both inside and outside radii to occur.

Accordingly, in one embodiment, to turn a corner (e.g., an outside radius), the rear portion of a vertical block 34 may be made shortened by knocking parts of the rear portion next to the groove 97 (already manufactured in the block) with a hammer to form a wedge-shaped block that is used to form the curved shape of the wall.

As previously discussed, a modular retaining wall block system of the present disclosure may be made utilizing blocks that are the same in size, shape, and depth. For example, where all standard blocks 32 are used, multi-split blocks may be used and/or blocks with straight splits may be used. In one embodiment, eight standard wall blocks may be made from a single mold.

Figure 22:
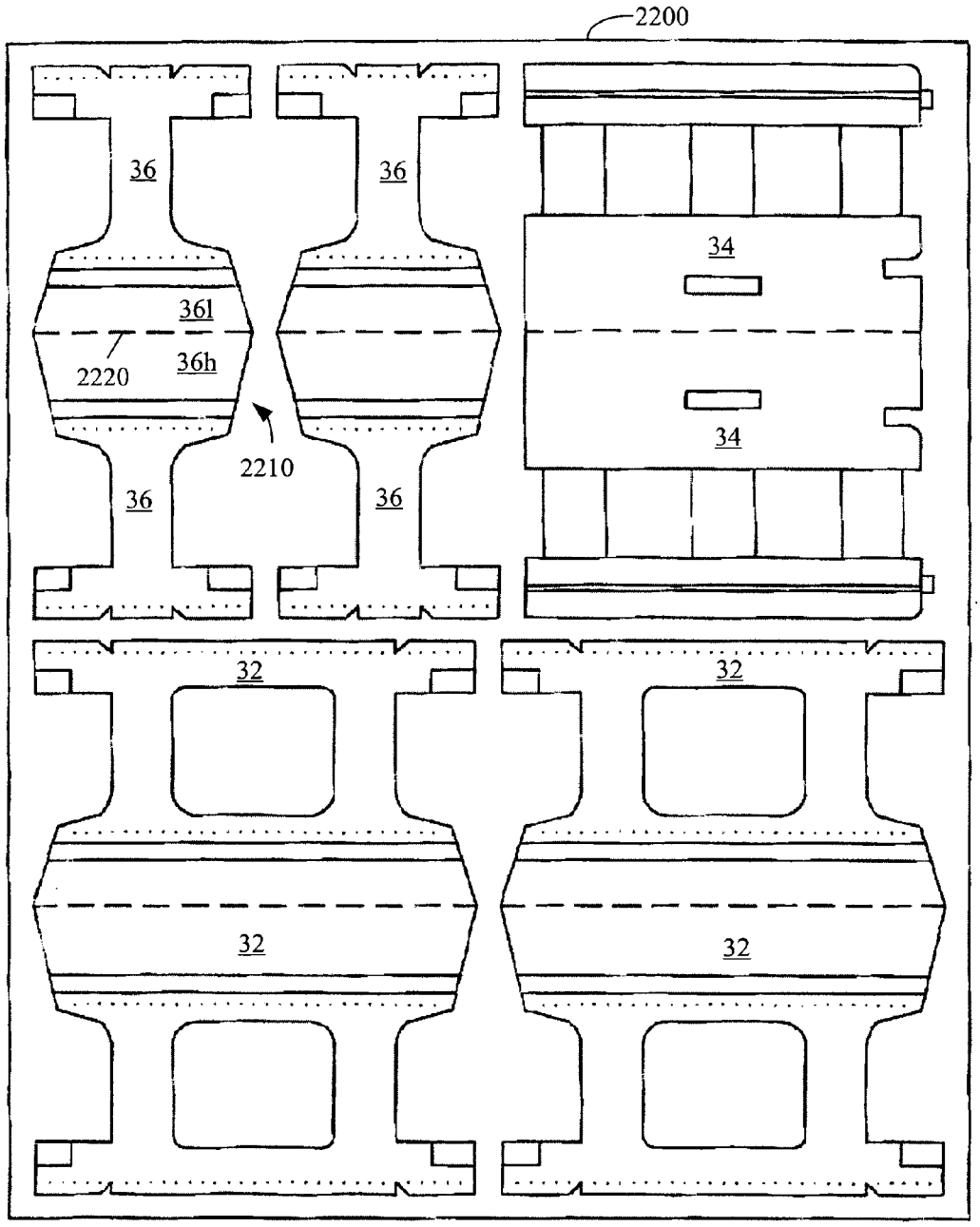
FIGS. 22-23 are diagrams of embodiments of a mold for forming wall blocks utilized in the wall structure described in FIG. 1.

Further, in some embodiments, a modular retaining wall block system may be made utilizing shapes of different size, shape, and depth. For example, a wall may be made using the standard 32, vertical 34, and half blocks 36. To add additional texture to the wall, the blocks may be made at different depths by utilizing different versions of the blocks with different offsets. Accordingly, FIG. 22 shows an embodiment of a mold system for producing wall blocks of three different size, shapes, and depth.

As shown, with a single mold 2200, four standard or horizontal blocks 32, two vertical blocks 34, and four half blocks 36 are produced. Further, different versions of the blocks 32, 34, 36 are produced with a split offset to produce blocks of different depth. For example, a pair 2210 of half blocks 36 is arranged with each block positioned face to face. Therefore, after a concrete mixture is poured into the mold and set, the pair of blocks are split, in an offset manner, along the dashed line 2220 produce a "high" block 36*h* and a "low" block 36*l*. This procedure is performed for each pair of blocks formed by the mold 2200. A typical dimension of a palette of blocks produced by the mold 2200 is 36"×48" in some embodiments. By utilizing blocks produced from this mold 2200 in an undesignated pattern results in a multi-textured wall without a set pattern. As previously explained, any row of the wall may be used with an anchoring system utilizing reinforcement members, such as a geogrid fabric. Alternatively, vertical columns or passageways are formed by the individual wall blocks and run the height of the wall from the bottom to the top, which may be used with an earth anchoring system utilizing tieback rods.

Figure 23:
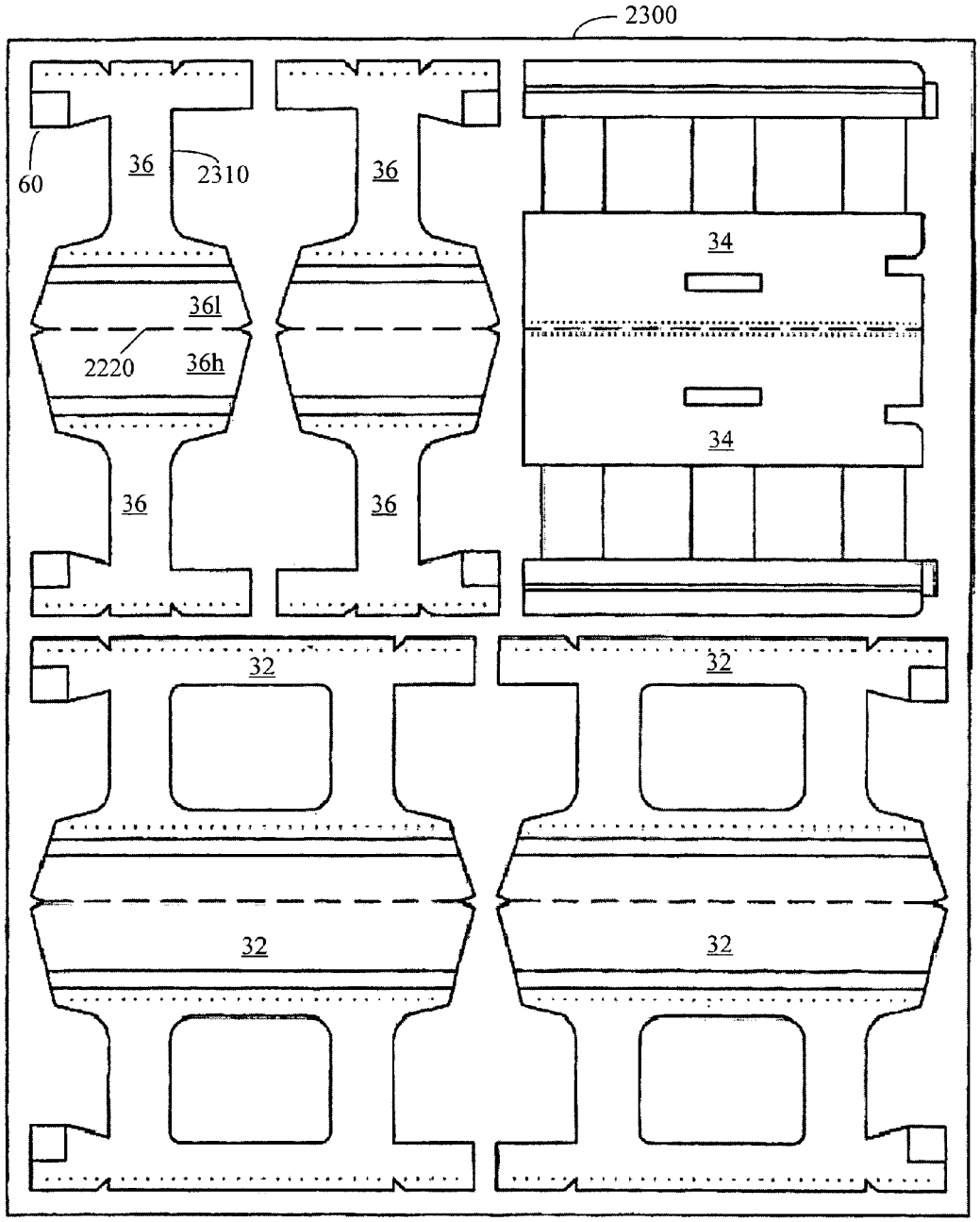

Note that in an alternative embodiment, a mold 2300, such as that represented in FIG. 23 may be provided. Here, the locking means 60 or node on the rear portion of the block 2310 is enlarged (e.g., 0.5 inch×0.5 inch) and provided only on one side of a respective block. With this approach, the enlarged node may provide additional security in adjoining other blocks positioned above and also allow for flexibility in positioning neighboring blocks on the same tier or course. Reference characters are repeated in FIG. 23 for corresponding parts that are also included in FIG. 22.

In accordance with the present disclosure, one embodiment of a modular wall block system is described below. The system includes wall blocks 30, 32, 34, 36 of different shapes and sizes having an interior face for forming an interior surface 40 of a modular retaining wall 10; an exterior face 40 for forming an exterior surface of the modular retaining wall 10; a top surface and a bottom surface; and first and second sides that extend from the exterior face to the interior face. In some of the blocks, one or more side channels 90, 92, 94, 96 is featured in the wall block, such the side channel 90, 92, 94, 96 extends inwardly towards a center of the wall block 30. When aligned with other wall blocks in a modular retaining wall 10, the side channel 90, 92, 94, 96 of the wall block acts to form a vertical passageway extending from the top of the wall 10 to the bottom. Further, support means, such as one or more rebar structures, may be positioned in the vertical passageway 80 to provide additional support to the modular retaining wall 10.

Portions of a vertical passageway 80 in a retaining wall structure 10 may be constructed by positioning wall blocks 30 such that the side channel 90 of one wall block is placed atop the side channel 90 of another wall block; positioning an interior opening 70 of a wall block atop an interior opening 70 of another wall block; positioning side channels 90 of neighboring wall blocks next to each other; positioning a side channel 90 of one block next to a side of another block; positing an interior opening 70 of a wall block atop a side of another wall block, etc.

Accordingly, the wall blocks used to construct a retaining wall structure 10, in some embodiments, are of different shapes and sizes, in accordance with the present disclosure. For example, in one embodiment, one type of wall block 32 has a plurality of side channels 92 and an interior opening 72 extending through the wall block 32 vertically from a top surface to a bottom surface, where the transverse width of the block 32 is substantially wider than a transverse width of another type of wall block 36. Further, one type of wall block 34 has a transversal width that is substantially the same as a transversal width of a different modular block 36, but has a longitudinal height that is substantially greater than the longitudinal height of the different modular block 32.

Further, in one embodiment of the system, a modular wall block system includes a plurality of wall blocks comprising first wall blocks of a first shape 32, 34, 36 and second wall blocks of a second shape 32, 34, 36 and at least one continuous passageway 80 running from a top of a wall 10 to a bottom of the wall 10 formed from the plurality of wall blocks 32, 34, 36. The wall blocks 32, 34, 36 are configured such that at least one continuous passageway 80 is formed when a plurality of blocks 32, 34, 36 are laid side by side in a tier and stacked one atop of another to form an additional tier. In a further embodiment, the wall blocks 32, 34, 36 also include third wall blocks of a third shape.

To stabilize the retaining wall structure in accordance with the present disclosure, one embodiment of an anchoring system includes a vertical passageway 80 formed within a modular retaining wall 10 from a top surface of the wall to a bottom surface of the modular retaining wall. Further, a plurality of tieback rods 1410 are provided, where the rods are adapted to be embedded into soil or rock and each having a proximal portion extending into the vertical passageway 80. At least one force distribution member 1520 is then positioned within the vertical passageway directly adjacent the proximal portions of the tieback rods 1410, such that tensile forces imposed upon the tieback rods are transmitted to the at least one force distribution member 1530 so as to distribute the tensile forces throughout a portion of the retaining wall 10.

In alternative embodiments, an anchoring system involves a plurality of wall blocks 30 stacked to form at least a portion of a wall 10. Each wall block 30 has an interior face, an exterior face; a top surface, and a bottom surface. The system further includes retaining means 1120, 1130 for securing at least one reinforcement member 1010, 1110 between stacked wall blocks 30, the retaining means including a pair of reinforcement member retaining bars 1120, 1130 that are positioned within a lateral alignment slot 95 or transverse channel that crosses the transverse width of the top surface of at least one wall block 30. A first of the retaining bars secures the at least one reinforcement member against the bottom of the slot, and a second of the retaining bars secures the first retaining bar against the side of the slot 95, such that the at least one reinforcement member is additionally secured between the pair of retaining bars 1120, 1130.

The first and second retaining bars 1120, 1130 include cooperative surfaces that function in combination with each other and the front and rear wall of the slot 95 to resist forces acting to move the reinforcement member within the slot or transverse channel 95. Further, the retainer bars 1120, 1130 may have a front to back dimension measuring from the top face of each retainer bar that is greater than a front to back dimension measuring from the bottom face of the retainer bar.

In some embodiments, the lateral alignment slot 95 is of such size and shape as to permit the first retainer bar to be inserted into the slot, with a portion of the reinforcement member 1010, 1110 interposed between the retainer bar and the walls of the lateral alignment slot 95. Then, the second retainer bar is inserted into the slot and mated with the first retainer bar, such that the mated pair of retainer bars 1120, 1130 cannot be removed from the slot or transverse channel 95. Accordingly, the reinforcement member 1010, 1110 is clamped between the first retainer bar and the channel rear wall and the first retainer bar and the second retainer bar when a tensile force is exerted on the portion of the reinforcement member 1010, 1110 extending behind the slot channel 95.

For example, in some embodiments, the retaining 1120, 1130 bar is sized and configured to have a width dimension on the top surface that is substantially half the width of a slot channel 95 through which the retaining bar is adapted to pass and a width dimension on the bottom surface that is less than the width of the top half, such that when the retaining bar has been inserted into an elongated channel (formed from aligned lateral alignment slots across a tier of blocks) through the opening and over the reinforcement member 1010, 1110 and mates with another retaining bar that is sized and configured to have a width dimension on the top surface that is substantially half the width of the elongated channel and a width dimension on the opposite bottom surface that is less than the width of the top surface, the retaining bar 1120, 1130 clamps the reinforcement member 1010, 1110 against the mating retainer bar 1120, 1130 within the elongated channel when a tensile force is applied to the reinforcement member 1010, 1110.

The present disclosure further provides embodiments of methods for modular retaining wall structures. One embodiment of such a method, among others, includes the steps of providing a plurality of wall blocks 30. Accordingly, each of the wall block has an exterior face and an interior face, top and bottom surfaces laying between the exterior and interior faces, first and second sides that extend from the exterior face to the interior face, and at least one side channel 95 extending inwardly towards a center of the wall block. The method further includes positioning a plurality of the wall blocks 30 to define a plurality of tier of blocks along a horizontal direction of the modular retaining wall 10, the positioning of the plurality of wall blocks also defining at least one vertical passageway 80 extending up and down a vertical direction of the modular retaining wall 10.

Positioning of the wall blocks 30 to form the vertical passageway 80 may be accomplished with one or more of the following steps. For example, the plurality of wall blocks 30 may be aligned such that a side channel 95 of one wall block is atop the side channel 95 of another wall block to form a portion of the at least one vertical passageway 80. Also, neighboring side channels 95 of adjacent wall blocks 30 may be aligned to form a portion of the vertical passageway 80 in a transversal direction. Aligning a side channel 95 of a wall block atop the interior opening 70 of another block 30 may also be performed to form a portion of the vertical passageway 80 in a longitudinal direction. Further, a side channel 95 of wall block 30 may be aligned atop a side channel 95 of a second wall block to form a portion of the vertical passageway 80 in a longitudinal direction. In addition, the step of aligning the interior opening 70 of the first block atop an interior opening of another block 30 to form a portion of the vertical passageway 80 in a longitudinal direction may also be performed. Other configurations may also be possible.

Another embodiment of a method for forming a modular retaining wall 10 includes the following steps: providing a plurality of wall blocks 30 of different shapes, each wall block 30 having an exterior face and an interior face, top and bottom surfaces laying between the exterior and interior faces, first and second sides that extend from the exterior face to the interior face, at least one of the first and second sides extending inwardly towards a center of the wall block 30 to form a side channel 95; and positioning a plurality of the wall blocks 30 of different sizes to define a plurality of tier of blocks along a horizontal direction of the modular retaining wall 10, the positioning of the plurality of wall blocks 30 defining at least one vertical passageway 80 extending up and down a vertical direction of the modular retaining wall 10 for any arrangement of the wall blocks.

To construct a retaining wall 10 near a portion of earth to be retained thereby, one embodiment of a method of the present disclosure involves the steps of embedding one end of at least one tieback rod 1410 within a portion of earth, whereby a protruding end extends outwardly freely from the portion of earth and stacking a plurality of blocks 30 in horizontally extending tiers to define a retaining wall 10, a plurality of the blocks 30 configured to define a longitudinally oriented passageway 80 between a top and bottom of the wall 10. Further, the method includes the step of inserting at least one elongate member 1530 into the passageway of the wall 10, the elongate member 1520 defining a point at which to secure a tieback rod 1410 to the wall. By orienting a tieback rod 1410 with respect to the at least one elongate member 1530 such that the protruding end of the rod 1410 extends within an interior of the vertical passageway 80; the tieback rod 1410 is then connected to the elongate member 1530 to secure the retaining wall to the portion of earth.

Alternatively, one embodiment of a method for forming a modular retaining wall utilizing an alternative anchoring system includes the step of providing a plurality of wall blocks 30, each wall block 30 having an exterior face and an interior face, and top and bottom surfaces laying between the exterior and interior faces, a transverse channel 95 being formed in the top surface of each wall block 30 and at least one locking means 60 being formed on the top surface of each wall block 30. The method further includes the step of positioning a plurality of the blocks 30 to define a lower tier of blocks such that the transverse channel 95 of respective blocks is in alignment. Then, at least one reinforcement member 1110 is placed on the top surfaces of wall blocks 30 in the lower tier, with the at least one reinforcement member 1110 extending from about the exterior faces of the associated wall blocks 30 in the lower tier, down into the transverse channels 95 of the associated wall blocks in the lower tier, past the interior faces of the associated wall blocks 30, and onto the soil to be reinforced behind the wall 10. Next, a pair of reinforcement member retaining bars 1120, 1130 is positioned in the transverse channels 95 of the associated wall blocks 30 in the lower tier, a first retaining bar of the pair securing the at least one reinforcement member 1110 against the bottom of the transverse channel 95 and the second retaining bar securing the first retaining bar against a side of the transverse channel 95, the second retaining bar additionally securing a portion of the reinforcement member 1110 against the first retaining bar 1120, 1130.

It should be emphasized that the above-described embodiments of the present disclosure are merely possible examples of implementations, merely set forth for a clear understanding of the principles of the disclosure. Many variations and modifications may be made to the above-described embodiments of the disclosure without departing substantially from the spirit and principles of the disclosure. All such modifications and variations are intended to be included herein within the scope of this disclosure.

Therefore, having thus described the invention, at least the following is claimed:

1. A modular block system, comprising:

a plurality of wall blocks stacked to form at least a portion of a wall, each wall block having an interior face, an exterior face; a top surface, and a bottom surface; and retaining means for securing at least one reinforcement member between stacked wall blocks, the retaining means including a pair of reinforcement member retaining bars that are positioned within a slot that crosses the transverse length of the top surface of at least one wall block, a first of the retaining bars securing the at least one reinforcement member against the bottom of the slot and a second of the retaining bars securing the first retaining bar against the side of the slot, such that the at least one reinforcement member is additionally secured between the pair of retaining bars, wherein a plurality of tiers of wall blocks are stacked one atop the other, each block including a slot that extends transversely across one of its surfaces and being adapted to receive a portion of a soil reinforcement member and a pair of reinforcement member retaining bars, each of the slot channels being defined by a front wall, a rear wall, and a channel bottom surface, the soil reinforcement member extending into the soil behind the wall, wherein the pair of reinforcement member retainer bars is positioned within the slot channels holding the portion of the reinforcement member, the pair of retainer bars functioning to hold the soil reinforcement member in place within the wall by mating a first retaining bar within the slot channel with a second retaining bar within the slot channel with the soil reinforcement member disposed between the first and second retaining bars such that the pair of retaining bars are secured within the slot channel, wherein the first and second retaining bars include cooperative surfaces that function in combination with each other and the front and rear wall of the slot channel to resist forces acting to move the soil reinforcement member within the slot channel, wherein the retaining bars have front, back, top, and bottom faces, the retainer bars having a front to back dimension measuring from the top face of each retainer bar that is greater than a front to back dimension measuring from the bottom face of the retainer bar.

2. The system of claim 1, wherein the slot channel is of such size and shape as to permit the first retainer bar to be inserted into the slot channel, with a portion of the soil reinforcement member interposed between the first retainer bar and the channel walls, and then the second retainer bar inserted into the slot channel and mating with the first retainer bar in which the mated pair of the first and second retainer bars cannot be removed from the slot channel, whereby the soil reinforcement member is clamped between the first retainer bar and the channel rear wall and the first retainer bar and the second retainer bar when a tensile force is exerted on the portion of the soil reinforcement member extending behind the slot channel.

3. The system of claim 1, wherein the wall blocks further include locking means on the top of each wall block to secure positioning of another wall block place atop of the wall block.

4. The system of claim 1, wherein the retaining bar is sized and configured to have a width dimension on the top surface that is substantially half the width of the slot channel through which the retaining bar is adapted to pass and a width dimension on the bottom surface that is less than the width of the top half such that when the retaining bar has been inserted into the slot channel through the opening and over the soul reinforcement member and mates with another retaining bar that is sized and configured to have a width dimension on the top surface that is substantially half the width of the slot channel and a width dimension on the opposite bottom surface that is less than the width of the top surface, the retaining bar clamps the soil reinforcement member against the mating retainer bar within the slot channel when a tensile force is applied to the soil reinforcement member.

5. The system of claim 1, wherein the soil reinforcement member comprises geogrid material in a lattice arrangement that comprises fabric composed of a polymeric material.

6. The system of claim 1, wherein the plurality of wall blocks is of different sizes and shapes.

7. An elongated retaining bar for securing a reinforcement member to a modular retaining wall comprised of a plurality of retaining wall blocks having transverse channels which align to form an elongated channel when the blocks are arranged in a course of the retaining wall, the retaining bar comprising:

a top surface;

a bottom surface formed opposite the top surface;

a front surface; and a rear surface formed opposite the front surface;

wherein the retaining bar is sized and configured to have a width dimension on the top surface that is substantially half the width of an elongated channel through which the retaining bar is adapted to pass and a width dimension on the bottom surface that is less than the width of the top half such that when the retaining bar has been inserted into the elongated channel through the opening and over the reinforcement member and mates with another retaining bar that is sized and configured to have a width dimension on the top surface that is substantially half the width of the elongated channel and a width dimension on the opposite bottom surface that is less than the width of the top surface, the retaining bar clamps the reinforcement member against the mating retainer bar within the elongated channel when a tensile force is applied to the reinforcement member.

8. The retaining bar of claim 7, wherein the retaining bar includes a cooperative surface that functions in combination with a cooperative surface of another retaining bar and a front and rear wall of the elongated channel to resist forces acting to move the reinforcement member within the elongated channel.

9. The retaining bar of claim 8, wherein the retaining bar has a front to back dimension measuring from the top face of the retainer bar that is greater than a front to back dimension measuring from the bottom face of the retainer bar.

10. The retaining bar of claim 8, wherein the reinforcement member comprises geogrid material in a lattice arrangement that comprises fabric composed of a polymeric material.

11. The method of claim 7, wherein the plurality of wall blocks is of different sizes and shapes.

12. A method for forming a modular retaining wall, the method comprising the steps of:

providing a plurality of wall blocks, each wall block having an exterior face and an interior face, and top and bottom surfaces laying between the exterior and interior faces, a transverse channel being formed in the top surface of each wall block and at least one locking means being formed on the top surface of each wall block;

positioning a plurality of the blocks to define a lower tier of blocks such that the transverse channel of respective blocks are in alignment;

placing at least one reinforcement member on the top surfaces of wall blocks in the lower tier, with the at least one reinforcement member extending from about the exterior faces of the associated wall blocks in the lower tier, down into the transverse channels of the associated wall blocks in the lower tier, past the interior faces of the associated wall blocks, and onto the soil to be reinforced behind the wall; and positioning a pair of reinforcement member retaining bars in the transverse channels of the associated wall blocks in the lower tier, a first retaining bar of the pair securing the at least one reinforcement member against the bottom of the transverse channel and the second retaining bar securing the first retaining bar against a side of the transverse channel, the second retaining bar additionally securing a portion of the reinforcement member against the first retaining bar, wherein the pair of reinforcement member retainer bars is positioned within the transverse channels holding the portion of the reinforcement member, the pair of retainer bars functioning to hold the reinforcement member in place within the wall by mating a first retaining bar within the transverse channel with a second retaining bar within the transverse channel with the reinforcement member disposed between the first and second retaining bars such that the pair of retaining bars are secured within the transverse channel, wherein the first and second retaining bars include cooperative surfaces that function in combination with each other and the front and rear wall of the transverse channel to resist forces acting to move the reinforcement member within the transverse channel, wherein the retaining bars have front, back, top, and bottom faces, the retainer bars having a front to back dimension measuring from the top face of each retainer bar that is greater than a front to back dimension measuring from the bottom face of the retainer bar.

13. The method of claim 12, wherein the plurality of wall blocks are of different sizes and shapes.

14. The method of claim 12, wherein the transverse channel is of such size and shape as to permit the first retainer bar to be inserted into the transverse channel, with a portion of the reinforcement member interposed between the retainer bar and the channel walls, and then the second retainer bar inserted into the transverse channel and mating with the first retainer bar in which the mated pair of first and second retainer bars cannot be removed from the transverse channel, whereby the reinforcement member is clamped between the first retainer bar and the channel rear wall and the first retainer bar and the second retainer bar when a tensile force is exerted on the portion of the reinforcement member extending behind the transverse channel.

15. The method of claim 12, wherein the reinforcement member comprises geogrid material.

16. The method of claim 12, further comprising the step of:

positioning a tier of wall blocks atop the transverse channel to further secure the retaining bars within the transverse channel.

17. The method of claim 12, wherein each wall blocks further includes locking means on the top of each wall block to secure positioning of another wall block place atop of the wall block.

18. The method of claim 12, wherein the retaining bar is sized and configured to have a width dimension on the top surface that is substantially half the width of the transverse channel through which the retaining bar is adapted to pass and a width dimension on the bottom surface that is less than the width of the top half such that when the retaining bar has been inserted into the transverse channel through the opening and over the reinforcement member and mates with another retaining bar that is sized and configured to have a width dimension on the top surface that is substantially half the width of the transverse channel and a width dimension on the opposite bottom surface that is less than the width of the top surface, the retaining bar clamps the reinforcement member against the mating retainer bar within the elongated channel when a tensile force is applied to the reinforcement member.

* * * * *